US007712523B2

(12) United States Patent
Snider et al.

(10) Patent No.: US 7,712,523 B2
(45) Date of Patent: May 11, 2010

(54) TOP DRIVE CASING SYSTEM

(75) Inventors: Randy Gene Snider, Houston, TX (US); David Shahin, Houston, TX (US); Jim Allen, Katy, TX (US); Kevin Gray, Friendswood, TX (US); Gary Thompson, Katy, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/389,483

(22) Filed: Mar. 14, 2003

(65) Prior Publication Data

US 2003/0173073 A1 Sep. 18, 2003

Related U.S. Application Data

(63) Continuation of application No. 09/550,721, filed on Apr. 17, 2000, now Pat. No. 6,536,520.

(51) Int. Cl.
*E21B 17/16* (2006.01)

(52) U.S. Cl. ..... 166/250.01; 166/66; 166/77.51; 166/380; 175/40

(58) Field of Classification Search ..... 175/40; 166/78.1, 77.51, 77.53, 250.01, 379, 380, 166/66; 73/152.59, 152.43, 152.49
See application file for complete search history.

(56) References Cited

U.S. PATENT DOCUMENTS

| | | | |
|---|---|---|---|
| 122,514 | A | 1/1872 | Bullock |
| 179,973 | A | 7/1876 | Thornton |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,386,908 | A | 8/1921 | Taylor |
| 1,418,766 | A | 6/1922 | Wilson |
| 1,471,526 | A | 10/1923 | Pickin |
| 1,518,634 | A | 12/1924 | Cason, Jr. |

(Continued)

FOREIGN PATENT DOCUMENTS

| | | |
|---|---|---|
| CA | 2 307 386 | 11/2000 |

(Continued)

OTHER PUBLICATIONS

WEAA, 417A-UK; Jul. 1998; GB; Pietras; *An Apparatus For Facilitating The Connection of Tubulars Using A Top Drive.*

(Continued)

*Primary Examiner*—Hoang Dang
(74) *Attorney, Agent, or Firm*—Patterson & Sheridan, LLP

(57) ABSTRACT

A torque head for gripping tubular members, in at least some aspects, has a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable.

44 Claims, 12 Drawing Sheets

U.S. PATENT DOCUMENTS

| | | | | |
|---|---|---|---|---|
| 1,585,069 | A | | 5/1926 | Youle |
| 1,708,378 | A | | 4/1929 | Dale |
| 1,728,136 | A | | 9/1929 | Power |
| 1,777,592 | A | | 10/1930 | Thomas |
| 1,805,007 | A | | 5/1931 | Pedley |
| 1,825,026 | A | | 9/1931 | Thomas |
| 1,830,625 | A | | 11/1931 | Schrock |
| 1,842,638 | A | | 1/1932 | Wigle |
| 1,880,218 | A | | 10/1932 | Simmons |
| 1,917,135 | A | | 7/1933 | Littell |
| 1,981,525 | A | | 11/1934 | Price |
| 1,998,833 | A | | 4/1935 | Crowell |
| 2,017,451 | A | | 10/1935 | Wickersham |
| 2,049,450 | A | | 8/1936 | Johnson |
| 2,060,352 | A | | 11/1936 | Stokes |
| 2,105,885 | A | | 1/1938 | Hinderliter |
| 2,128,430 | A | | 8/1938 | Pryor |
| 2,167,338 | A | | 7/1939 | Murcell |
| 2,184,681 | A | | 12/1939 | Osmun et al. |
| 2,214,194 | A | | 9/1940 | Frankley |
| 2,214,429 | A | | 9/1940 | Miller |
| 2,216,895 | A | | 10/1940 | Stokes |
| 2,228,503 | A | | 1/1941 | Boyd et al. |
| 2,295,803 | A | | 9/1942 | O'Leary |
| 2,305,062 | A | | 12/1942 | Church et al. |
| 2,324,679 | A | | 7/1943 | Cox |
| 2,370,832 | A | | 3/1945 | Baker |
| 2,379,800 | A | | 7/1945 | Hare |
| 2,414,719 | A | | 1/1947 | Cloud |
| 2,499,630 | A | | 3/1950 | Clark |
| 2,522,444 | A | | 9/1950 | Grable |
| 2,536,458 | A | | 1/1951 | Munsinger |
| 2,570,080 | A | | 10/1951 | Stone |
| 2,610,690 | A | | 9/1952 | Beatty |
| 2,621,742 | A | | 12/1952 | Brown |
| 2,627,891 | A | | 2/1953 | Clark |
| 2,633,339 | A | | 3/1953 | Storm |
| 2,641,444 | A | | 6/1953 | Moon |
| 2,650,314 | A | | 8/1953 | Hennigh et al. |
| 2,663,073 | A | | 12/1953 | Bieber et al. |
| 2,666,689 | A | | 2/1954 | Cormany |
| 2,692,059 | A | | 10/1954 | Bolling, Jr. |
| 2,720,267 | A | | 11/1955 | Brown |
| 2,738,011 | A | | 3/1956 | Mabry |
| 2,741,907 | A | | 4/1956 | Genender et al. |
| 2,743,087 | A | | 4/1956 | Layne et al. |
| 2,743,495 | A | | 5/1956 | Eklund |
| 2,764,329 | A | | 9/1956 | Hampton |
| 2,765,146 | A | | 10/1956 | Williams |
| 2,805,043 | A | | 9/1957 | Williams |
| 2,950,639 | A | | 8/1960 | Mason |
| 2,953,406 | A | | 9/1960 | Young |
| 2,965,177 | A | | 12/1960 | Bus, Sr. et al. |
| 2,978,047 | A | | 4/1961 | DeVaan |
| 3,006,415 | A | | 10/1961 | Bums et al. |
| 3,021,739 | A | | 2/1962 | Grundmann |
| 3,041,901 | A | | 7/1962 | Knights |
| 3,054,100 | A | | 9/1962 | Jones |
| 3,086,413 | A | | 4/1963 | Mason |
| 3,087,546 | A | | 4/1963 | Wooley |
| 3,090,031 | A | | 5/1963 | Lord |
| 3,102,599 | A | | 9/1963 | Hillbum |
| 3,111,179 | A | | 11/1963 | Albers et al. |
| 3,117,636 | A | | 1/1964 | Wilcox et al. |
| 3,122,811 | A | | 3/1964 | Gilreath |
| 3,123,160 | A | | 3/1964 | Kammerer |
| 3,124,023 | A | | 3/1964 | Marquis et al. |
| 3,131,586 | A | | 5/1964 | Wilson |
| 3,131,769 | A | | 5/1964 | Rochemont |
| 3,159,219 | A | | 12/1964 | Scott |
| 3,169,592 | A | | 2/1965 | Kammerer |
| 3,180,186 | A | | 4/1965 | Catland |
| 3,191,677 | A | | 6/1965 | Kinley |
| 3,191,680 | A | | 6/1965 | Vincent |
| 3,191,683 | A | | 6/1965 | Alexander |
| 3,193,116 | A | | 7/1965 | Kenneday et al. ..... 173/164 |
| 3,220,245 | A | | 11/1965 | Van Winkle |
| 3,266,582 | A | | 8/1966 | Homanick |
| 3,302,496 | A | | 2/1967 | Mitchell et al. |
| 3,349,455 | A | | 10/1967 | Doherty |
| 3,353,599 | A | | 11/1967 | Swift |
| 3,380,528 | A | | 4/1968 | Timmons |
| 3,387,893 | A | | 6/1968 | Hoever |
| 3,392,609 | A | | 7/1968 | Bartos |
| 3,419,079 | A | | 12/1968 | Current |
| 3,420,344 | A | | 1/1969 | Hilpert, et al. |
| 3,443,291 | A | | 5/1969 | Doherty |
| 3,475,038 | A | | 10/1969 | Matherne |
| 3,477,527 | A | | 11/1969 | Koot |
| 3,489,220 | A | | 1/1970 | Kinley |
| 3,511,349 | A | | 5/1970 | Herscovici |
| 3,518,903 | A | | 7/1970 | Ham et al. |
| 3,548,936 | A | | 12/1970 | Kilgore et al. |
| 3,550,684 | A | | 12/1970 | Cubberly, Jr. |
| 3,552,507 | A | | 1/1971 | Brown |
| 3,552,508 | A | | 1/1971 | Brown |
| 3,552,509 | A | | 1/1971 | Brown |
| 3,552,510 | A | | 1/1971 | Brown |
| 3,552,848 | A | | 1/1971 | Van Wagner |
| 3,559,739 | A | | 2/1971 | Hutchison |
| 3,566,505 | A | | 3/1971 | Martin |
| 3,570,598 | A | | 3/1971 | Johnson |
| 3,575,245 | A | | 4/1971 | Cordary et al. |
| 3,602,302 | A | | 8/1971 | Kluth |
| 3,603,411 | A | | 9/1971 | Link |
| 3,603,412 | A | | 9/1971 | Kammerer, Jr. et al. |
| 3,603,413 | A | | 9/1971 | Grill et al. |
| 3,606,664 | A | | 9/1971 | Weiner |
| 3,624,760 | A | | 11/1971 | Bodine |
| 3,635,105 | A | | 1/1972 | Dickmann et al. ..... 81/57.18 |
| 3,638,989 | A | | 2/1972 | Sandquist |
| 3,656,564 | A | | 4/1972 | Brown |
| 3,662,842 | A | * | 5/1972 | Bromell ..... 173/1 |
| 3,669,190 | A | | 6/1972 | Sizer et al. |
| 3,680,412 | A | | 8/1972 | Mayer et al. |
| 3,691,624 | A | | 9/1972 | Kinley |
| 3,691,825 | A | | 9/1972 | Dyer |
| 3,692,126 | A | | 9/1972 | Rushing et al. |
| 3,696,332 | A | | 10/1972 | Dickson, Jr. et al. |
| 3,700,048 | A | | 10/1972 | Desmoulins |
| 3,706,347 | A | | 12/1972 | Brown |
| 3,722,331 | A | | 3/1973 | Radulescu |
| 3,729,057 | A | | 4/1973 | Werner |
| 3,746,330 | A | | 7/1973 | Taciuk |
| 3,747,675 | A | | 7/1973 | Brown ..... 166/237 |
| 3,760,894 | A | | 9/1973 | Pitifer |
| 3,766,991 | A | | 10/1973 | Brown |
| 3,776,320 | A | | 12/1973 | Brown ..... 173/163 |
| 3,780,883 | A | | 12/1973 | Brown |
| 3,785,193 | A | | 1/1974 | Kinley et al. |
| 3,796,418 | A | | 3/1974 | Carlberg |
| 3,808,916 | A | | 5/1974 | Porter et al. |
| 3,838,613 | A | | 10/1974 | Wilms |
| 3,840,128 | A | | 10/1974 | Swoboda, Jr. et al. |
| 3,848,684 | A | | 11/1974 | West |
| 3,857,450 | A | | 12/1974 | Guier |
| 3,870,114 | A | | 3/1975 | Pulk et al. |
| 3,871,618 | A | | 3/1975 | Funk |
| 3,881,375 | A | | 5/1975 | Kelly |
| 3,885,679 | A | | 5/1975 | Swoboda, Jr. et al. |
| 3,893,556 | A | | 7/1975 | Lech, Jr., et al. |
| 3,901,331 | A | | 8/1975 | Djurovic |
| 3,913,687 | A | | 10/1975 | Gyongyosi et al. |
| 3,915,244 | A | | 10/1975 | Brown |

3,933,108 A 1/1976 Baugh
3,934,660 A 1/1976 Nelson
3,941,348 A 3/1976 Mott
3,945,444 A 3/1976 Knudson
3,947,009 A 3/1976 Nelmark
3,964,552 A 6/1976 Slator
3,964,556 A 6/1976 Gearhart et al.
3,980,143 A 9/1976 Swartz et al.
3,986,564 A 10/1976 Bender
3,999,610 A 12/1976 Sage et al.
4,005,621 A 2/1977 Turner, Jr. et al.
4,049,066 A 9/1977 Richey
4,054,332 A 10/1977 Bryan, Jr.
4,054,426 A 10/1977 White
4,064,939 A 12/1977 Marquis
4,077,525 A 3/1978 Callegari et al.
4,082,144 A 4/1978 Marquis
4,083,405 A 4/1978 Shirley
4,085,808 A 4/1978 Kling
4,091,451 A 5/1978 Weiner et al.
4,095,865 A 6/1978 Denison et al.
4,100,968 A 7/1978 Delano
4,100,981 A 7/1978 Chaffin
4,127,927 A 12/1978 Hauk et al.
4,133,396 A 1/1979 Tschirky
4,142,739 A 3/1979 Billingsley
4,159,637 A 7/1979 Lamb et al.
4,170,908 A 10/1979 Peveto et al.
4,173,457 A 11/1979 Smith
4,175,619 A 11/1979 Davis
4,186,628 A 2/1980 Bonnice
4,189,185 A 2/1980 Kammerer, Jr. et al.
4,194,383 A 3/1980 Huzyak
4,199,032 A 4/1980 Weiner et al.
4,202,225 A 5/1980 Sheldon et al.
4,221,269 A 9/1980 Hudson
4,227,197 A 10/1980 Nimmo et al.
4,241,878 A 12/1980 Underwood
4,246,809 A 1/1981 Keast et al.
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshbhy
4,281,722 A 8/1981 Tucker et al.
4,287,949 A 9/1981 Lindsey, Jr.
4,291,762 A 9/1981 Gudgel
4,295,527 A 10/1981 Russe
4,311,195 A 1/1982 Mullins, II
4,315,553 A 2/1982 Stallings
4,320,915 A 3/1982 Abbott et al.
4,334,444 A 6/1982 Carestensen et al.
4,336,415 A 6/1982 Walling
4,346,629 A 8/1982 Kinzbach
4,365,402 A 12/1982 McCombs et al.
4,384,627 A 5/1983 Ramirez-Jauregui
4,392,534 A 7/1983 Miida
4,396,076 A 8/1983 Inoue
4,396,077 A 8/1983 Radtke
4,401,000 A 8/1983 Kinzbach
4,402,239 A 9/1983 Mooney
4,407,378 A 10/1983 Thomas
4,408,669 A 10/1983 Wiredal
4,413,682 A 11/1983 Callihan et al.
4,427,063 A 1/1984 Skinner
4,437,363 A 3/1984 Haynes ..... 81/57.18
4,440,220 A 4/1984 McArthur
4,442,892 A 4/1984 Delesandri
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
RE31,699 E 10/1984 Eckel
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates ..... 81/57.18
4,499,919 A 2/1985 Forester
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,561,529 A 12/1985 McIntosh
4,565,003 A 1/1986 McLeod
4,570,706 A 2/1986 Pugnet ..... 166/77.5
4,573,359 A 3/1986 Carstensen
4,580,631 A 4/1986 Baugh
4,583,603 A 4/1986 Dorleans et al.
4,589,495 A 5/1986 Langer et al.
4,592,125 A 6/1986 Skene
4,593,584 A 6/1986 Neves
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,613,161 A 9/1986 Brisco
4,620,600 A 11/1986 Persson
4,625,796 A 12/1986 Boyadjieff
4,630,691 A 12/1986 Hooper
4,643,259 A 2/1987 Zeringue, Jr.
4,646,827 A 3/1987 Cobb
4,649,777 A 3/1987 Buck ..... 81/57.19
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,682,678 A 7/1987 Kussel et al.
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck ..... 81/57.18
4,709,766 A 12/1987 Boyadjieff
4,712,284 A 12/1987 Coyle, Sr. et al.
4,715,451 A 12/1987 Bseisu et al.
4,715,625 A 12/1987 Shows, Jr. et al.
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al. ..... 81/57.34
4,760,882 A 8/1988 Novak
4,762,187 A 8/1988 Haney
4,765,401 A 8/1988 Boyadjieff
4,765,416 A 8/1988 Bjerking et al.
4,773,218 A 9/1988 Wakita et al.
4,773,689 A 9/1988 Wolters
4,775,009 A 10/1988 Wittrisch et al.
4,778,008 A 10/1988 Gonzalez et al.

4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al. ..... 175/85
4,806,928 A 2/1989 Veneruso
4,811,635 A 3/1989 Falgout, Sr.
4,813,493 A 3/1989 Shaw et al. ..... 173/164
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator ..... 81/57.18
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al. ..... 166/77.5
4,875,530 A 10/1989 Frink et al.
4,878,546 A 11/1989 Shaw et al. ..... 173/163
4,880,058 A 11/1989 Lindsey et al.
4,883,125 A 11/1989 Wilson et al.
4,899,816 A 2/1990 Mine
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,938,109 A 7/1990 Torres et al.
4,960,173 A 10/1990 Cognevich et al.
4,962,579 A 10/1990 Moyer et al.
4,962,819 A 10/1990 Bailey et al.
4,962,822 A 10/1990 Pascale
4,971,146 A 11/1990 Terrell
4,979,356 A 12/1990 Vatne
4,997,042 A 3/1991 Jordan et al.
5,000,065 A 3/1991 Haynes
5,009,265 A 4/1991 Bailey et al.
5,022,472 A 6/1991 Bailey et al.
5,027,914 A 7/1991 Wilson
5,036,927 A 8/1991 Willis
5,044,232 A 9/1991 Schulze-Beckinghausen
5,049,020 A 9/1991 McArthur
5,050,691 A 9/1991 Moses
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,092,399 A 3/1992 Lang
5,096,465 A 3/1992 Chen et al.
5,107,940 A 4/1992 Berry
5,109,924 A 5/1992 Jurgens et al.
5,111,893 A 5/1992 Kvello-Aune
5,141,063 A 8/1992 Quesenbury
RE34,063 E 9/1992 Vincent et al.
5,144,298 A 9/1992 Henneuse
5,148,875 A 9/1992 Karlsson et al.
5,150,642 A 9/1992 Moody et al.
5,156,213 A 10/1992 George et al.
5,159,860 A 11/1992 Pietras
5,160,925 A 11/1992 Dailey et al.
5,161,438 A 11/1992 Pietras
5,161,548 A 11/1992 Neville
5,167,173 A 12/1992 Pietras
5,168,942 A 12/1992 Wydrinski
5,172,765 A 12/1992 Sas-Jaworsky
5,176,518 A 1/1993 Hordijk et al.
5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
5,199,542 A 4/1993 Flotow
6,374,506 B1 4/1993 Clay
5,209,302 A 5/1993 Robichaux et al.
5,221,099 A 6/1993 Jansch
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson ..... 175/220
5,255,741 A 10/1993 Alexander
5,255,751 A 10/1993 Stogner
5,259,275 A 11/1993 Schulze-Beckinghausen
5,261,517 A 11/1993 Hering
5,271,468 A 12/1993 Streich et al.
5,271,472 A 12/1993 Leturno
5,272,925 A * 12/1993 Henneuse et al. ..... 73/862.541
5,282,653 A 2/1994 LaFleur et al. ..... 285/110
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al. ..... 294/102.2
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,852 A 6/1994 Cornette et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,347,859 A 9/1994 Henneuse et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,390,568 A 2/1995 Pietras
5,392,715 A 2/1995 Pelrine
5,394,823 A 3/1995 Lenze
5,402,856 A 4/1995 Warren et al.
5,433,279 A 7/1995 Tessari et al.
5,435,400 A 7/1995 Smith
5,451,084 A 9/1995 Jansch
5,452,923 A 9/1995 Smith
5,456,317 A 10/1995 Hood, III et al.
5,458,209 A 10/1995 Hayes et al.
5,461,905 A * 10/1995 Penisson ..... 73/46
5,472,057 A 12/1995 Winfree
5,477,925 A 12/1995 Trahan et al.
5,494,122 A 2/1996 Larsen et al.
5,497,840 A 3/1996 Hudson
5,501,280 A 3/1996 Brisco
5,501,286 A 3/1996 Berry
5,503,234 A 4/1996 Clanton
5,520,072 A 5/1996 Perry
5,520,255 A 5/1996 Barr et al.
5,526,880 A 6/1996 Jordan, Jr. et al.

5,535,824 A 7/1996 Hudson
5,535,838 A 7/1996 Keshavan et al.
5,538,121 A 7/1996 Hering
5,540,279 A 7/1996 Branch et al.
5,542,472 A 8/1996 Pringle et al.
5,542,473 A 8/1996 Pringle et al.
5,547,029 A 8/1996 Rubbo et al.
5,547,314 A 8/1996 Ames
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al. ..... 175/321
5,582,259 A 12/1996 Barr
5,584,343 A 12/1996 Coone
5,588,916 A 12/1996 Moore
5,613,567 A 3/1997 Hudson
5,615,747 A 4/1997 Vail, III
5,634,671 A 6/1997 Watkins
5,645,131 A 7/1997 Trevisani ..... 175/171
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,667,045 A 9/1997 Cummings, III
5,697,442 A 12/1997 Baldridge
5,706,893 A 1/1998 Morgan
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A * 3/1998 Schulze-Beckinghausen et al. ..... 285/18
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,765,638 A 6/1998 Taylor
5,772,514 A 6/1998 Moore
5,785,132 A 7/1998 Richardson et al.
5,785,134 A 7/1998 McLeod et al.
5,787,978 A 8/1998 Carter et al.
5,787,982 A 8/1998 Bakke
5,791,410 A 8/1998 Castille et al.
5,794,703 A 8/1998 Newman et al.
5,803,191 A 9/1998 Mackintosh
5,803,666 A 9/1998 Keller
5,813,456 A 9/1998 Milner et al.
5,819,605 A 10/1998 Buck et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde ..... 166/321
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,390 A 12/1998 Bouligny et al.
5,842,530 A 12/1998 Smith et al.
5,845,549 A 12/1998 Bouligny
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,947,214 A 9/1999 Tibbitts
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.
5,988,273 A 11/1999 Monjure et al.
5,992,801 A 11/1999 Torres
6,000,472 A 12/1999 Albright et al. ..... 166/380
6,012,529 A 1/2000 Mikolajczyk et al.
6,024,169 A 2/2000 Haugen
6,026,911 A 2/2000 Angle et al.
6,035,953 A 3/2000 Rear
6,056,060 A * 5/2000 Abrahamsen et al. ..... 166/380
6,059,051 A 5/2000 Jewkes et al.
6,059,053 A 5/2000 McLeod
6,061,000 A 5/2000 Edwards
6,062,326 A 5/2000 Strong et al.
6,065,372 A 5/2000 Rauch
6,065,550 A 5/2000 Gardes
6,070,500 A 6/2000 Dlask et al. ..... 81/57.33
6,070,671 A 6/2000 Cumming et al.
6,079,498 A 6/2000 Lima et al.
6,079,509 A 6/2000 Bee et al.
6,082,224 A 7/2000 McDaniels et al.
6,082,225 A 7/2000 Richardson
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,138,529 A 10/2000 Pietras
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al. ..... 173/55
6,202,764 B1 3/2001 Ables et al.
6,206,096 B1 3/2001 Belik
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,629 B1 5/2001 Bangert
6,223,823 B1 5/2001 Head
6,227,587 B1 5/2001 Terral
6,234,257 B1 5/2001 Ciglenec et al.

6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,276,450 B1 8/2001 Seneviratne
6,279,654 B1 8/2001 Mosing et al.
6,290,432 B1 9/2001 Exley et al.
6,296,066 B1 10/2001 Terry et al.
6,305,469 B1 10/2001 Coenen et al.
6,305,720 B1 10/2001 Spiering et al.
6,309,002 B1 10/2001 Bouligny
6,311,792 B1 11/2001 Scott et al. ..... 175/162
6,315,051 B1 11/2001 Ayling
6,325,148 B1 12/2001 Trahan et al.
6,327,938 B1 12/2001 Pietras
6,330,911 B1 12/2001 Allen et al.
6,334,376 B1 1/2002 Torres
6,343,649 B1 2/2002 Beck et al.
6,347,674 B1 2/2002 Bloom et al.
6,347,706 B1 2/2002 D'Ambrosio
6,349,764 B1 2/2002 Adams et al.
6,357,485 B2 3/2002 Quigley et al.
6,359,569 B2 3/2002 Beck et al.
6,360,633 B2 3/2002 Pietras
6,367,552 B1 4/2002 Scott et al.
6,367,566 B1 4/2002 Hill
6,371,203 B2 4/2002 Frank et al.
6,374,706 B1 4/2002 Newman
6,374,924 B1 4/2002 Hanton et al.
6,378,627 B1 4/2002 Tubel et al.
6,378,630 B1 4/2002 Ritorto et al.
6,378,633 B1 4/2002 Moore
6,385,837 B1 5/2002 Murakami et al.
6,390,190 B2 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,435,280 B1 8/2002 Van Wechem et al.
6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,480,811 B2 11/2002 Denny et al.
6,484,818 B2 11/2002 Alft et al.
6,497,280 B2 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al. ..... 166/78.1
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Melcalfe et al.
6,547,017 B1 4/2003 Vail, III
6,553,825 B1 * 4/2003 Boyd ..... 73/152.59
6,554,064 B1 4/2003 Restarick et al.
6,585,040 B2 7/2003 Hanton et al.
6,591,471 B1 7/2003 Hollingsworth et al.
6,595,288 B2 * 7/2003 Mosing et al. ..... 166/285
6,619,402 B1 9/2003 Amory et al.
6,622,796 B1 9/2003 Pietras
6,634,430 B2 10/2003 Dawson et al.
6,637,526 B2 10/2003 Juhasz et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,040 B1 3/2004 Sensenig
6,708,769 B2 3/2004 Haugen et al.
6,715,430 B2 4/2004 Choi et al.
6,719,071 B1 4/2004 Moyes
6,725,924 B2 4/2004 Davidson et al.
6,725,938 B1 4/2004 Pietras
6,725,949 B2 4/2004 Seneviratne
6,732,822 B2 5/2004 Slack et al.
6,742,584 B1 6/2004 Appleton
6,742,596 B2 6/2004 Haugen
6,742,606 B2 6/2004 Metcalfe et al.
6,745,834 B2 6/2004 Davis et al.
6,752,211 B2 6/2004 Dewey et al.
6,776,233 B2 8/2004 Meehan
6,832,656 B2 12/2004 Fournier, Jr. et al.
6,832,658 B2 12/2004 Keast
6,837,313 B2 1/2005 Hosie et al.
6,840,322 B2 1/2005 Haynes
6,848,517 B2 2/2005 Wardley
6,854,533 B2 2/2005 Galloway
6,857,486 B2 2/2005 Chitwood et al.
6,857,487 B2 2/2005 Galloway et al.
6,868,906 B1 3/2005 Vail, III et al.
6,877,553 B2 4/2005 Cameron
6,889,772 B2 5/2005 Buytaert et al.
6,892,835 B2 5/2005 Shahin et al.
6,896,075 B2 5/2005 Haugen et al.
6,899,186 B2 5/2005 Galloway et al.
6,907,934 B2 6/2005 Kauffman et al.
6,938,697 B2 9/2005 Haugen
7,073,598 B2 7/2006 Haugen
7,096,977 B2 8/2006 Juhasz et al.
7,100,698 B2 9/2006 Kracik et al.
7,140,445 B2 11/2006 Shahin et al.
7,188,686 B2 3/2007 Folk et al.
7,281,587 B2 10/2007 Haugen
2001/0042625 A1 11/2001 Appleton
2002/0029878 A1 3/2002 Victor
2002/0040787 A1 4/2002 Cook et al.
2002/0066556 A1 6/2002 Goode et al.
2002/0108748 A1 8/2002 Keyes
2002/0134555 A1 9/2002 Allen et al.
2002/0170720 A1 11/2002 Haugen
2002/0189863 A1 12/2002 Wardley
2003/0029641 A1 2/2003 Maehan
2003/0056991 A1 3/2003 Hahn et al.
2003/0070841 A1 4/2003 Merecka et al.
2003/0111267 A1 6/2003 Pia
2003/0141111 A1 7/2003 Pia
2003/0146023 A1 8/2003 Pia
2003/0155159 A1 8/2003 Slack et al.
2003/0164251 A1 9/2003 Tulloch
2003/0164276 A1 9/2003 Snider et al.
2003/0173073 A1 9/2003 Snider et al.
2003/0173090 A1 9/2003 Cook et al.
2003/0217865 A1 11/2003 Simpson et al.
2003/0221519 A1 12/2003 Haugen et al.
2004/0003490 A1 1/2004 Shahin et al.
2004/0003944 A1 1/2004 Vincent et al.
2004/0011534 A1 1/2004 Simonds et al.

| | | | |
|---|---|---|---|
| 2004/0060697 | A1 | 4/2004 | Tilton et al. |
| 2004/0069500 | A1 | 4/2004 | Haugen |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0051343 | A1 | 3/2005 | Pietras et al. |
| 2005/0096846 | A1 | 5/2005 | Koithan et al. |
| 2005/0098352 | A1 | 5/2005 | Beierbach et al. |
| 2006/0180315 | A1 | 8/2006 | Shahin et al. |
| 2007/0000668 | A1 | 1/2007 | Christensen |

FOREIGN PATENT DOCUMENTS

| | | |
|---|---|---|
| CA | 2 335 192 | 11/2001 |
| DE | 3 213 464 | 10/1983 |
| DE | 3 523 221 | 2/1987 |
| DE | 35 23 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 311 455 | 4/1989 |
| EP | 0 423 055 | 4/1991 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 215 967 | 12/1970 |
| GB | 1 277 461 | 6/1972 |
| GB | 1 306 568 | 3/1973 |
| GB | 1 448 304 | 9/1976 |
| GB | 1 469 661 | 4/1977 |
| GB | 2 049 518 | 12/1980 |
| GB | 1 582 392 | 1/1981 |
| GB | 2 053 088 | 2/1981 |
| GB | 2 115 940 | 9/1983 |
| GB | 2 128 526 | 5/1984 |
| GB | 2 170 528 | 8/1986 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2 300 896 | 11/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 346 576 | 8/2000 |
| GB | 2 346 577 | 8/2000 |
| GB | 2 347 445 | 9/2000 |
| GB | 2 348 223 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 381 809 | 5/2003 |
| GB | 2 382 361 | 5/2003 |
| GB | 2 386 626 | 9/2003 |
| GB | 2 389 130 | 12/2003 |
| JP | 2001-173349 | 6/2001 |
| WO | WO 83/03443 | 10/1983 |
| WO | WO 90-06418 | 6/1990 |
| WO | WO 91-16520 | 10/1991 |
| WO | WO 92-01139 | 1/1992 |
| WO | WO 92-18743 | 10/1992 |
| WO | WO 92/18744 | 10/1992 |
| WO | WO 92-20899 | 11/1992 |
| WO | WO 93-07358 | 4/1993 |
| WO | WO 93/18276 | 9/1993 |
| WO | WO 93-24728 | 12/1993 |
| WO | WO 95-10686 | 4/1995 |
| WO | WO 95/20471 | 8/1995 |
| WO | WO 96-18799 | 6/1996 |
| WO | WO 96-28635 | 9/1996 |
| WO | WO 97-05360 | 2/1997 |
| WO | WO 97-08418 | 3/1997 |
| WO | WO 98/01651 | 1/1998 |
| WO | WO 98-05844 | 2/1998 |
| WO | WO 98-09053 | 3/1998 |
| WO | WO 98-11322 | 3/1998 |
| WO | WO 98/16716 | 4/1998 |
| WO | WO 98-32948 | 7/1998 |
| WO | WO 98/32948 | 7/1998 |
| WO | WO 98-55730 | 12/1998 |
| WO | WO 99-04135 | 1/1999 |
| WO | WO 99-11902 | 3/1999 |
| WO | WO 99-23354 | 5/1999 |
| WO | WO 99-24689 | 5/1999 |

| | | |
|---|---|---|
| WO | WO 99/34089 | 7/1999 |
| WO | WO 99/34090 | 7/1999 |
| WO | WO 99/34091 | 7/1999 |
| WO | WO 99-35368 | 7/1999 |
| WO | WO 99-37881 | 7/1999 |
| WO | WO 99-41485 | 8/1999 |
| WO | WO 99-50528 | 10/1999 |
| WO | WO 99-58810 | 11/1999 |
| WO | WO 99-64713 | 12/1999 |
| WO | WO 00/04269 | 1/2000 |
| WO | WO 00-05483 | 2/2000 |
| WO | WO 00-08293 | 2/2000 |
| WO | WO 00/09853 | 2/2000 |
| WO | WO 00-11309 | 3/2000 |
| WO | WO 00-11310 | 3/2000 |
| WO | WO 00-11311 | 3/2000 |
| WO | WO 00/22278 | 4/2000 |
| WO | WO 00/23686 | 4/2000 |
| WO | WO 00-28188 | 5/2000 |
| WO | WO 00-37766 | 6/2000 |
| WO | WO 00-37771 | 6/2000 |
| WO | WO 00-39429 | 7/2000 |
| WO | WO 00-39430 | 7/2000 |
| WO | WO 00/41487 | 7/2000 |
| WO | WO 00/45026 | 8/2000 |
| WO | WO 00/45027 | 8/2000 |
| WO | WO 00-46484 | 8/2000 |
| WO | WO 00-50730 | 8/2000 |
| WO | WO 00/52297 | 9/2000 |
| WO | WO 00/66879 | 11/2000 |
| WO | WO 00-66879 | 11/2000 |
| WO | WO 00/79092 | 12/2000 |
| WO | WO 01/03889 | 1/2001 |
| WO | WO 01/09479 | 2/2001 |
| WO | WO 01-12946 | 2/2001 |
| WO | WO 01/33033 | 5/2001 |
| WO | WO 01/38688 | 5/2001 |
| WO | WO 01-46550 | 6/2001 |
| WO | WO 01/46550 | 6/2001 |
| WO | WO 01/59253 | 8/2001 |
| WO | WO 01/66905 | 9/2001 |
| WO | WO 01-79650 | 10/2001 |
| WO | WO 01/79652 | 10/2001 |
| WO | WO 01-81708 | 11/2001 |
| WO | WO 01-83932 | 11/2001 |
| WO | WO 01-94738 | 12/2001 |
| WO | WO 01-94739 | 12/2001 |
| WO | WO 02/14649 | 2/2002 |
| WO | WO 02-44601 | 6/2002 |
| WO | WO 02-081863 | 10/2002 |
| WO | WO 02-086287 | 10/2002 |
| WO | WO 03/006790 | 1/2003 |
| WO | WO 03-074836 | 9/2003 |
| WO | WO 03-087525 | 10/2003 |
| WO | WO 2004/022903 | 3/2004 |
| WO | WO 2004/079155 | 9/2004 |

OTHER PUBLICATIONS

WEAA, 417B-UK; Jul. 1998; GB; Pietras; *An Apparatus For Facilitating The Connection of Tubulars Using A Top Drive*.
WEAA, 417C-UK; Jul. 1998; GB; Pietras; *An Apparatus For Facilitating The Connection of Tubulars Using A Top Drive*.
WEAA, 417D-UK; Jul. 1998; GB; Pietras; *An Apparatus For Facilitating The Connection of Tubulars Using A Top Drive*.
*Autoseal Circulating Head*; LaFleur Petroleum Services, 1992.
Valves, Wellhead Equipment, Safety System; W-K-M Division, ACF Industries, 1980.
*Top Drive Drilling Systems*, Canrig. Feb. 1997 in Hart's Petroleum Engineer.
*More Portable Top Drive Installations*, Tesco Drilling Technology, 1997.
*Portable Top Drives*, Drilling-Contractor, Cover & 3 pp., Sep. 1994.
*500 or 650 HCIS Top Drive*, Tesco Drilling Technology, Apr. 1998.
Product Information, (Sections 1-10) Canrig, 1996.
U.S. Appl. No. 08/755,128, filed Nov. 22, 1996.
U.S. Appl. No. 10/189,570, filed Jun. 6, 2002.
U.S. Appl. No. 10/618,093, filed Jul. 11, 2003.
Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.
M.B. Stone and J. Smith, "Expandable Tubulars and Casing Driling are Options" Drilling Contractor, Jan./Feb. 2002, pp. 52.
M. Gelfgat, "Retractable Bits Development and Application" Transactions of the ASME, vol. 120, Jun. 1998, pp. 124-130.
"First Success with Casing-Drilling" Word Oil, Feb. 1999, pp. 25.
Dean E. Gaddy, Editor, "Russia Shares Technical Know-How with U.S." Oil & Gas Journal, Mar. 1999, pp. 51-52 and 54-56.
Rotary Steerable Technology—Technology Gains Momentum, Oil & Gas Journal, Dec. 28, 1998.
Directional Drilling, M. Mirns, World Oil, May 1999, pp. 40-43.
Multilateral Classification System w/Example Applications, Alan MacKenzie & Cliff Hogg, World Oil, Jan. 1999, pp. 55-61.
Tarr, et al., "Casing-while-Drilling: The Next Step Change in Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Linear Technology For Depleted Reservoir," SPE Paper 36827, SPE Annual Technical Conference And Exhibition, Oct. 22-24, pp. 127-132.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr. 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled." CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.

Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74468, IADC/SPE Drilling Conference, Feb. 26-28, 2002; pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Linear And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Linear Utilizing a New Inner String Linear Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expandable Solid Tubulars To Solve Well Construction Challenges in Deep Waters And Maturing Properties, IBP 27500, Brazilian Petroleum Institute—IBP, 2000.
Coiled Tubing Handbook, World Oil, Guff Publishing Company, 1993.
EP Search Report, Application No. 06100988.2, dated Jul. 7, 2006.
Dennis L. Bickford and Mark J. Mabile, Casing Drilling Rig Selection For Stratton Field, Texas, World Oil, vol. 226 No., Mar. 2005.
G H. Kemphorst, G. L. Van Wechem, W. Boom, D. Bottger, and K. Koch, Casing Running Tool, SPE/IADC 52770.
John Doyle, et al.. Basic Concepts, Feedback Control Theory, Macmillian Publishing Co., 1990, I, ii, 33-44 and 209-212.

Portable Top Drive Drilling System, Tesco Drilling Technology, 1994, TESTWFT0000695—TESWFT0000736.

Prosecution History for U.S. Appl. No. 11/932,610 from Oct. 31, 2007-Aug. 25, 2009, including the following: Response to Final Office Action dated Apr. 14, 2009, Final Office Action dated Apr. 14, 2009, Response to Office Action dated Sep. 4, 2008, Office Action dated Sep. 4, 2008.

* cited by examiner

TOP DRIVE CASING SYSTEM

CROSS-REFERENCE TO RELATED APPLICATIONS

This application is a continuation of U.S. patent application Ser. No. 09/550,721, filed Apr. 17, 2000, now U.S. Pat. No. 6,536,520. The aforementioned related patent application is herein incorporated by reference in its entirety.

BACKGROUND OF THE INVENTION

1. Field of the Invention

The present invention is directed to wellbore operations, top drives, top drive casing systems and operations, torque heads, top drives with torque heads, and methods using them.

2. Description of the Related Art

The prior art discloses many systems and methods for running casing. The prior art also discloses a variety of systems using a top drive for running casing. Certain prior art top drive systems include the attachment of a spider (e.g. but not limited to, a flush mounted spider) suspended beneath a top drive from the bails.

The bails are then rigidly fastened to a top drive quill so as to cause the flush mounted spider to rotate in unison with any rotation of the quill. Engagement of the flush mounted spider's slips with a casing joint or string causes the casing to rotate in coordinated unison with the spider. FIG. 17 shows a prior art top drive in which the collective assembly beneath a bull gear is able to rotate and is collectively referred to as the "pipe handling" or "handler" system. This pipe handling system can be made to slue in coordination with the quill by rigidly affixing the bails to the quill. In certain embodiments of such a system since the top drive's pipe handling system rotates with the tool at all times, rotation is limited to the design speed limit of the system's seals and bearings—about 6 rpm in some cases. This can add many hours to a casing job. The present inventors have recognized that a system is needed that can rotate significantly faster during the spin-in phase of makeup, like a tong and which would only engage a pipe handler to turn the tool after makeup if there is a stuck pipe situation. Another disadvantage with such systems is that by making the torque head the primary hoisting device the cost of the device is increased and also, in many cases, makes it necessary to produce or own different size/tonnage range torque head assemblies to cover both different size ranges and within size ranges, different tonnages. The present inventors have recognized a need for a system that allows a rig to utilize hoisting equipment it already owns for primary hoisting and a system with a torque head that is lighter, i.e. a less expensive device capable of use universally within a size range regardless of tonnage requirements.

With many known prior art devices, apparatuses and systems 10 with which casing is gripped, e.g. by jaws, inserts, or dies, the casing is damaged. Such damage can result in casing which cannot be used. When premium tubulars are required, such damage is very expensive.

There has long been a need for an efficient and effective 15 system and method for running casing (making-up and breaking-out connections) with a top drive. There has long been a need for such a system and method which provides for continuous fluid circulation during running operations. There has long been a need for such a system and method that efficiently and effectively rotates casing and applies downward force on a casing string while the string is being installed in a wellbore. There has long been a need for such systems and methods which reduce damage to casing. There has long been a need for such a system and method wherein an apparatus that grips casing does not become locked on the casing.

SUMMARY OF THE INVENTION

The present invention, in certain aspects, provides a system with a top drive and its related apparatus, and a torque head connected to and below the top drive in a rig for selectively gripping casing. The present invention, in certain embodiments, discloses a torque head useful in such systems and methods, the torque head with jaws with grip members, including but not limited to, slips, dies, and inserts; and in one particular aspect slips with movable dies or inserts that have some degree of axial freedom with respect to the jaws so that, in one aspect, when the slips first contact the exterior of a casing section the dies or inserts move axially with respect to the casing rather than radially, i.e. initially they do not bite, or bite only minimally, into the casing. Then, as the casing is moved by the top drive slips allow limited vertical movement both upward and downward. This allows the slips, dies or inserts to move upward relative to the slips as they engage the casing and to move downward relative to the slips as they are disengaged from the casing.

In certain embodiments a fluid circulation tool or apparatus is mounted in a torque head according to the present invention. Part of this tool is introduced into the top of a casing joint when the joint is being hoisted and readied for makeup to a casing string. With appropriate sealing packers, the joint is filled with circulation fluid and then moved into position above the casing string. Once makeup commences, circulating fluid is circulated through the joint and to the casing string.

In certain particular embodiments of the present invention relative axial movement of the torque head with respect to a casing joint being gripped by the slips is also made possible by providing a mounting plate assembly that includes bolts holding it together and springs that allow some controlled axial movement of the torque head. With the slips gripping the casing, a torque head barrel is rigidly fixed relative to the casing and if the casing is made up to the string or is gripped at the spider, downward force on the torque head assembly causes the springs located in the top plate to compress and allows for limited axial movement relative to the casing and elevator, provided the elevator slips are engaged on the casing. Such a torque head can be used with the previously mentioned movable dies, etc., (which engage the casing when they are moved axially downwardly relative to the inner diameter of the torque head) and which are disengaged by axial movement upwardly relative to an inner diameter of the torque head. In the event the torque head assembly is subjected to a dangerous axial load of predetermined amount (e.g., but not limited to, about 100 tons or more), the bolts fail before significant damage is done to the torque head. When the bolts fail, the top plate assembly separates from the torque head barrel while the slips of the torque head assembly remain engaged against the casing, thus causing the barrel and slip mechanism within the barrel to remain firmly attached to the casing and prevent it from free falling the rig floor. This also reduces the possibility of items falling down (e.g. the torque head) and injuring personnel.

In certain aspects, selectively controlled piston/cylinder devices are used to move the slips into and out of engagement with a casing joint. In certain embodiments the piston/cylinder assemblies have internal flow control valves and accumulators so that once the slips engage the casing, hydraulic pressure is maintained in the cylinders and the slips remain in engagement with the casing.

Methods according to the present invention with systems 20 according to the present invention are more automated than previous systems because in various prior art systems the torque head can become locked onto the casing when the slips of an elevator (or other suspension/clamping device) are engaged against the casing after the slips of the torque head have been engaged. This condition is a result of the actuation of hydraulic cylinders and then not being able to provide sufficient force to disengage the slips and overcome the mechanical advantage created by the wedging action of slip assemblies without some relative vertical movement of the casing. With the slips of the elevator set, this relative vertical movement of the casing is prevented. The same condition exists for the slips of the elevator in various prior art systems so that the torque head and elevator are locked onto the casing. Various methods are employed to prevent or preclude the torque head from becoming locked onto the casing. In one aspect the dies are capable of some vertical movement relative to the slips. In another aspect in the torque head barrel some limited vertical movement relative to the casing is allowed due to the two-piece construction of the torque head barrel top assembly with incorporated spring washers. When the need to use a power tong to makeup a casing string is eliminated, as with systems according to the present invention, the need for a tong running crew is also eliminated.

It is, therefore, an object of at least certain preferred 10 embodiments of the present invention to provide: New, useful, unique, efficient, and novel and non-obvious system and methods for running casing with a top drive;

Such systems and methods which provide automated operations;

Such systems and methods which provide continuous fluid circulation during operations;

Such systems and methods which reduce or eliminate damage to casing by using grippers with movable dies or inserts (marking or non-marking); that prevent a torquing apparatus from becoming locked onto casing and/or which reduce or eliminate axial loading on a torquing apparatus and/or by providing for shear release of the torque head from an item, e.g. a top drive connected to it.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

BRIEF DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DETAILED DESCRIPTION OF THE PREFERRED EMBODIMENT

Figure 1:
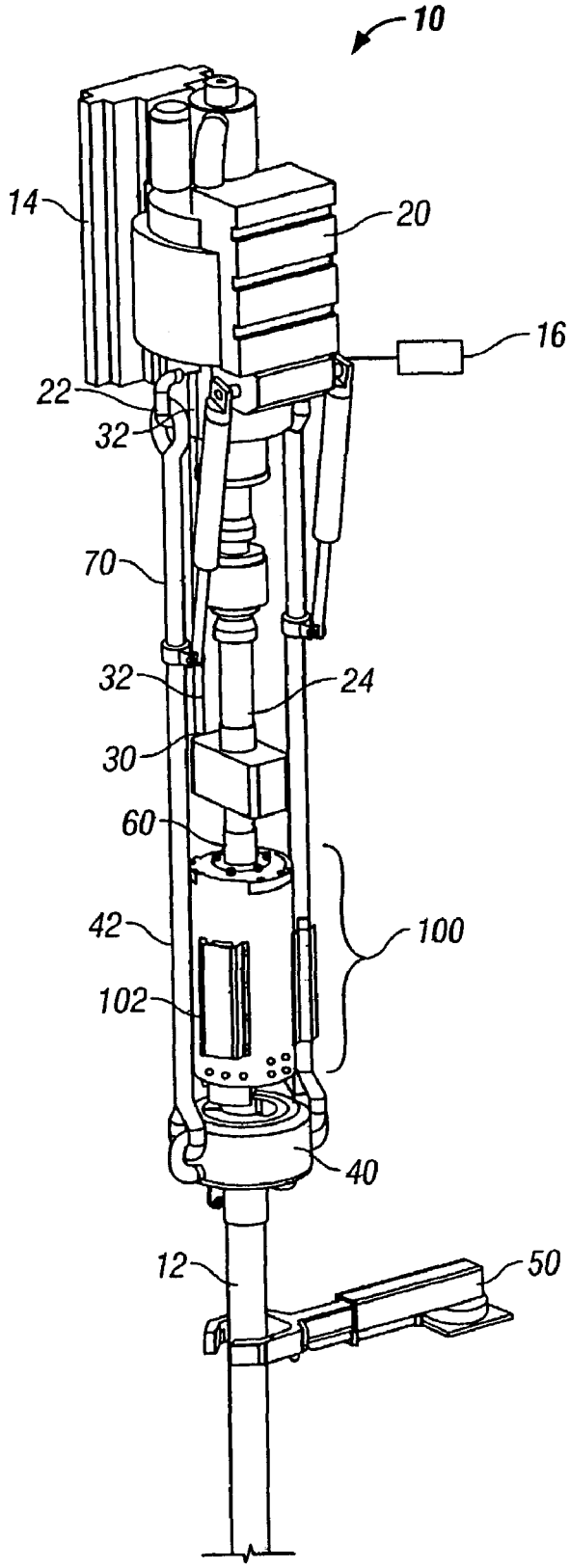
FIG. 1 is a perspective view of a system according to the present invention.
Figure 2:
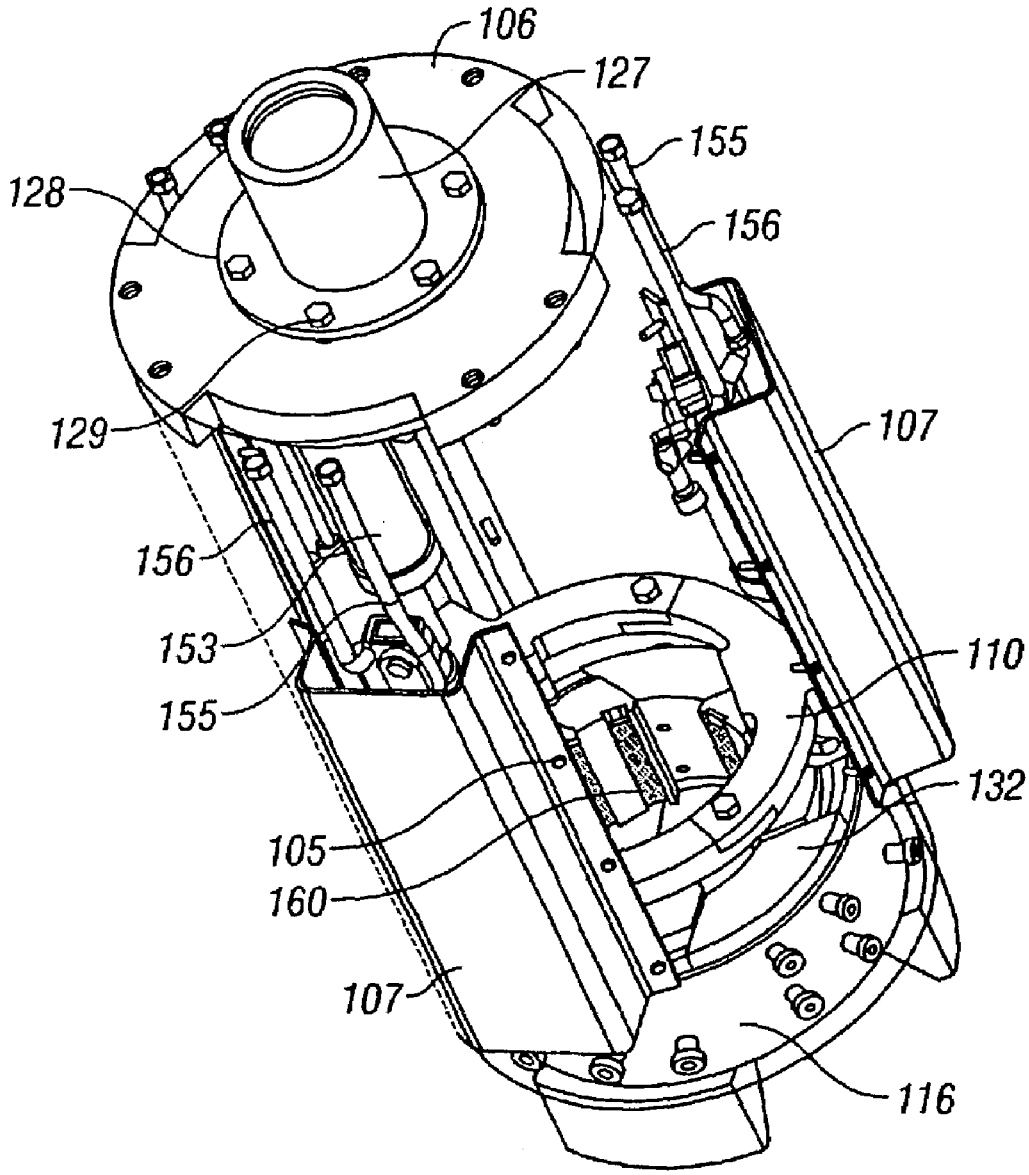
FIG. 2 is a perspective view of a part of a torque head according to the present invention.

Referring now to FIG. 1, a system 10 according to the present invention includes a top drive 20, a torque wrench assembly 30 used for back-up, an elevator 40 (which may also be any suitable known suspendable selective clamping apparatus or device), a pipe handler 50, and a torque head 100. The elevator 40 is suspended by bails 42 from eyes 22 of the top drive 20. The torque wrench assembly 30 is suspended by a support 32 from the top drive 20.

A torque sub 60 interconnects a spindle 24 (also called a "a quill") of the top drive 20 and the top of a joint of casing 12 that extends into the torque head 100. Rotation of the spindle 24 by the top drive 20 rotates the torque sub 60 and the casing joint 12. A top portion of the casing 12 (or of a casing coupling if one is used) extends into the torque head 100.

A selectively operable bail movement apparatus 70 (also called a "pipe handler") moves the bails 42 and elevator 40 as desired. The top drive 20 is movably mounted to part 14 of a rig (not shown). The top drive, top drive controls, torque wrench assembly, torque sub, elevator, bail movement apparatus and pipe handler may be any suitable known apparatuses as have been used, are used, and/or are commercially available.

Preferably the torque head is positioned above the elevator and the torque head is connected to the top drive spindle. In one particular embodiment the spindle or "quill" projects down into a top barrel of the torque head about 5.625 inches. The spindle is threadedly connected to the top of the torque head.

By controlling and selectively rotating the spindle 24 with the top drive 20, hoisting, lowering and torquing of casing is controlled via controls 16 (shown schematically) of the top drive 20. The torque sub 60 is interconnected with and in communication with controls 16 and it monitors torque applied to casing, e.g. during a makeup operation.

With the spindle or quill 24 engaged by the back-up assembly 30, the bails 42, elevator 40, and torque head 100 rotate together, thereby rotating a casing string (not shown) whose top joint is engaged by the torque head 100 while the string is lowered or raised. This is advantageous in the event the casing becomes stuck during setting operations; it is desirable to be able to rotate the casing string while it is being lowered.

Figure 7:
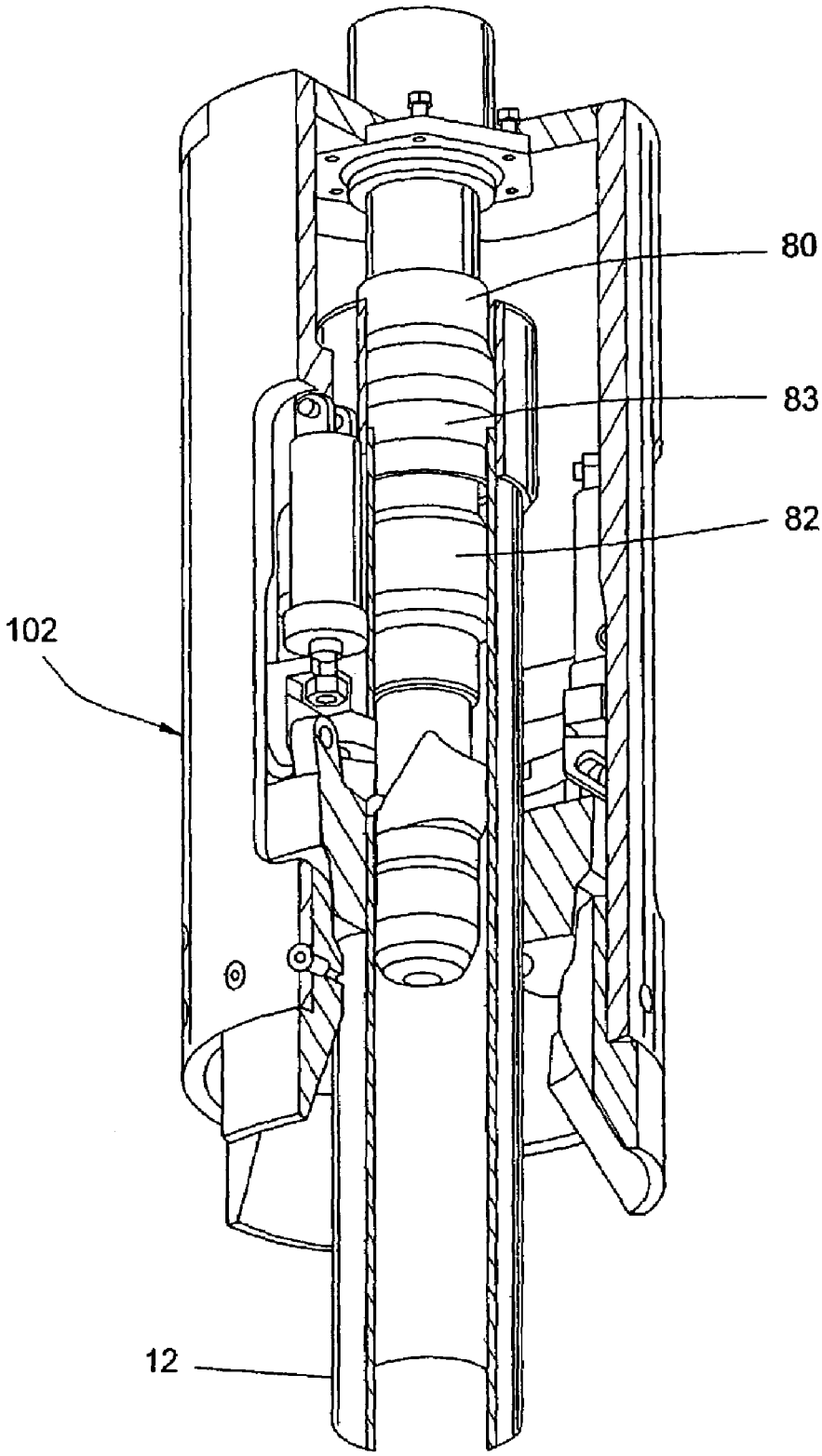
FIG. 7 is a perspective view of the torque head of FIG. 2 with 5 a circulation apparatus therein.

As shown in FIG. 7 a commercially available fillip-circulating 25 tool 80 (e.g. but not limited to a LaFleur Petroleum Services Auto Seal Circulating tool) within the torque head 100 has an end 81 inserted into the casing joint 12 when the joint 12 is being hoisted by the rig drawworks and readied for makeup to a casing string extending from the rig down into an earth wellbore. A lower packer element 82 of the tool 80 seals against the interior of the joint 12 so the joint can be filled with circulation fluid or mud. By moving the tool 80 further down within the joint 12 and sealing off the casing's interior with an upper packer element 83, circulation of drilling fluid is effected through the torque head, through the casing, and to the casing string.

As shown in FIGS. 2-7, the torque head 100 has an outer housing or barrel 102 with upper recesses 104 corresponding to projections 106 of a top plate 108. Bolts 109 bolt the top plate 108 to the housing 102. A leveling bar 110 with three sub-parts 111, 112, 113 bolted together by bolts 114 is threadedly secured to piston/cylinder apparatuses described below by pins or bolts, and the piston/cylinder apparatuses are connected to the housing 102 described below (via mounting clips). Lower sleeve portions 121, 122, 123 secured by bolts 115 to a ring 116 are spaced apart by three jaw guides 131, 132, 133 which are secured to the ring 116 (FIG. 2) by bolts 117. Jaws 141, 142, 143 each have a top member 144 positioned between ears 119 of the bar 110, each with a shaft 145 that moves in a corresponding slot 118 in the leveling bar 110 as they are raised and lowered by pistons 154 of piston/cylinder apparatuses 151, 152, 153. Lower ends of the pistons 154 are threaded for connection to part of the bar 110. Slips 160 are secured to the jaws. The controls 16 and fluid power system associated therewith or any typical rig fluid power system may be used to selectively actuate and deactivate the piston/cylinder apparatuses.

Shields 107 are bolted with bolts 105 to the housing 102. Each piston/cylinder apparatus 151, 152, 153 has flow lines 155, 156 in fluid communication with it for the selective provision of power fluid to the piston/cylinder apparatus. With a pin 157, each piston/cylinder apparatus 151-153 is connected to the housing 102, e.g. by clips.

Figure 4:
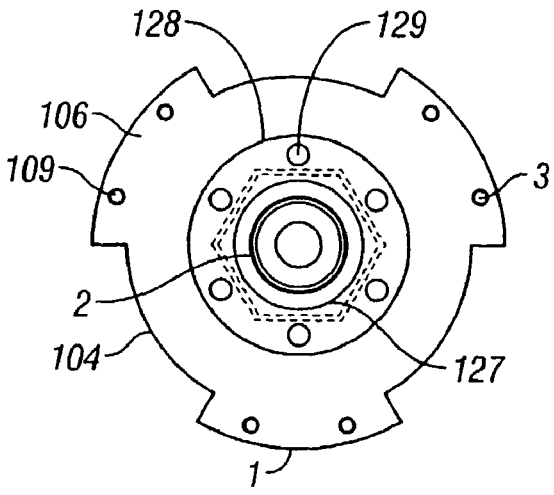
FIG. 4 is a top view of parts of the torque head of FIG. 2.
Figure 6:
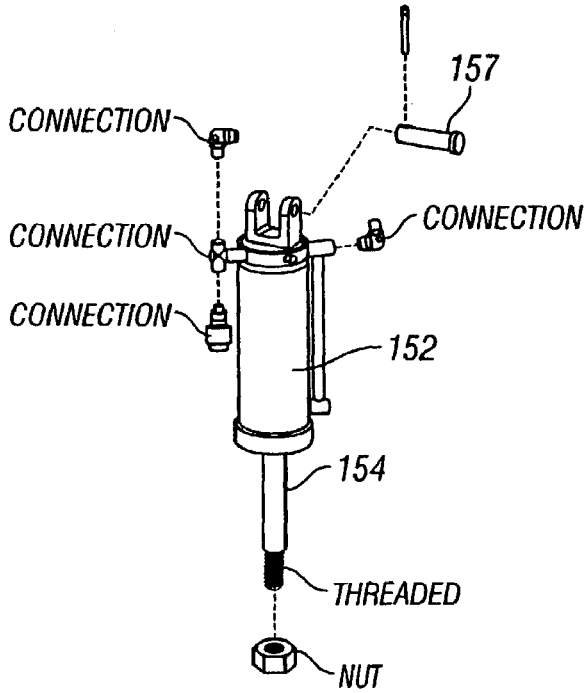
FIG. 6 is an enlarged view of a piston/cylinder device of the torque head of FIG. 2.
Figure 5:
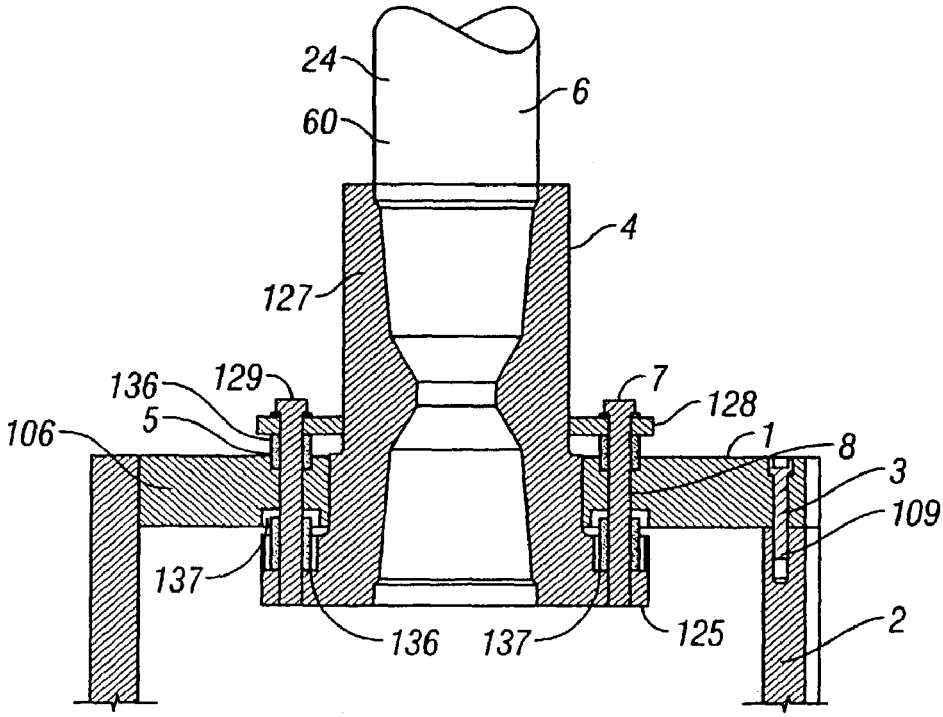
FIG. 5 is a side cross-section view of part of the torque head of FIG. 2.

The hollow top barrel 127 with a flange 128 is bolted to the top plate 106 by bolts 129. Optionally, the top barrel 127 may be mounted to the housing 102 as shown in FIGS. 4 and 5 with bolts 129 extending through the flange 128 with suitable washers or springs 136, e.g. but not limited to belleville springs, around each bolt. Each bolt 109 extends down into a lower flange 125 of the top barrel 127. Of course it is within the scope of this invention to have the top barrel 127 yieldably and movably mounted to the top plate 106 with any suitable fasteners (screws, bolts, rivets, or studs and to use any suitable spring(s) or spring apparatus(es) between the top barrel 127 and plate 106 to provide a desired degree of axial movement between these two items. This in turn permits controlled relative axial movement of the torque head relative to the casing due to the movement of the dies with respect to the slips 160. Some of the belleville springs 136 are in recesses 137 in the plate 106.

Figure 3:
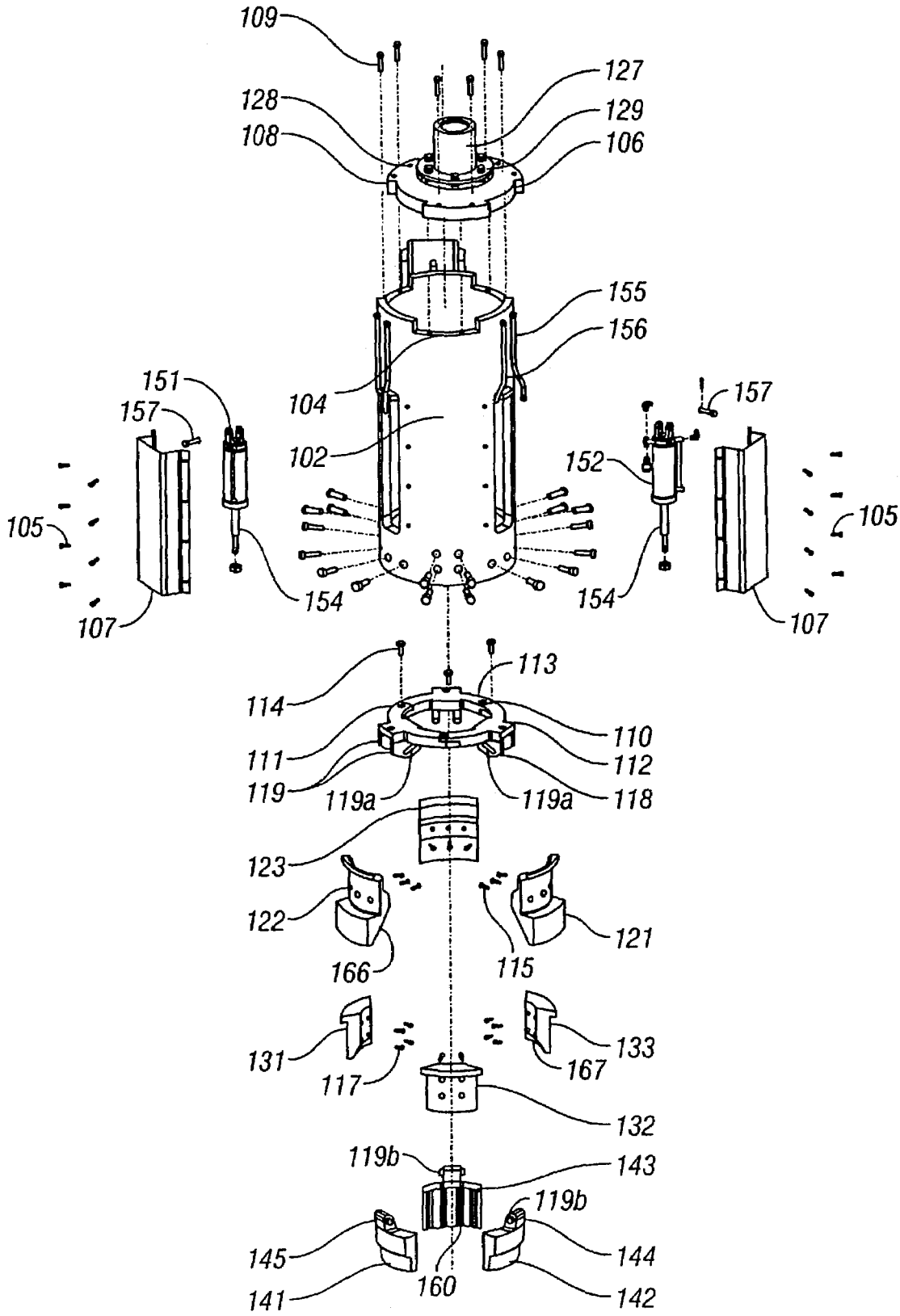
FIG. 3 is an exploded view of the torque head of FIG. 2.

As shown in FIG. 3, the lower sleeves each has an inclined portion 166 that facilitates entry of a top of a casing joint into the torque head 100. Each jaw guide also has an inclined portion 167 that facilitates entry of a top of a casing joint into the torque head 100. Each lower sleeve 121-123 is positioned behind one of the pairs of ears 119 of the leveling bar 110 and serves as a back up or stop for each jaw. Cam followers **119*b* are attached to the slips and mounted in oblique slots 119*a*** on the leveling bar free oblique motion of the slips relative to the sleeves.

Lines 155, 156 in fluid communication with a system (not shown) for selectively providing fluid under pressure, e.g. a typical rig fluid pressure system. The lines connect the hydraulic actuating cylinders to an hydraulic rotating swivel union 206 (see FIG. 11) which allows hydraulic fluid to be distributed to the cylinders as they rotate with the top drive spindle or quill. The rotating swivel union 206 permits the cylinders to rotate without twisting the hydraulic lines. The cylinders are controlled by a remotely located selector valve (item 222, FIG. 11).

Figure 11:
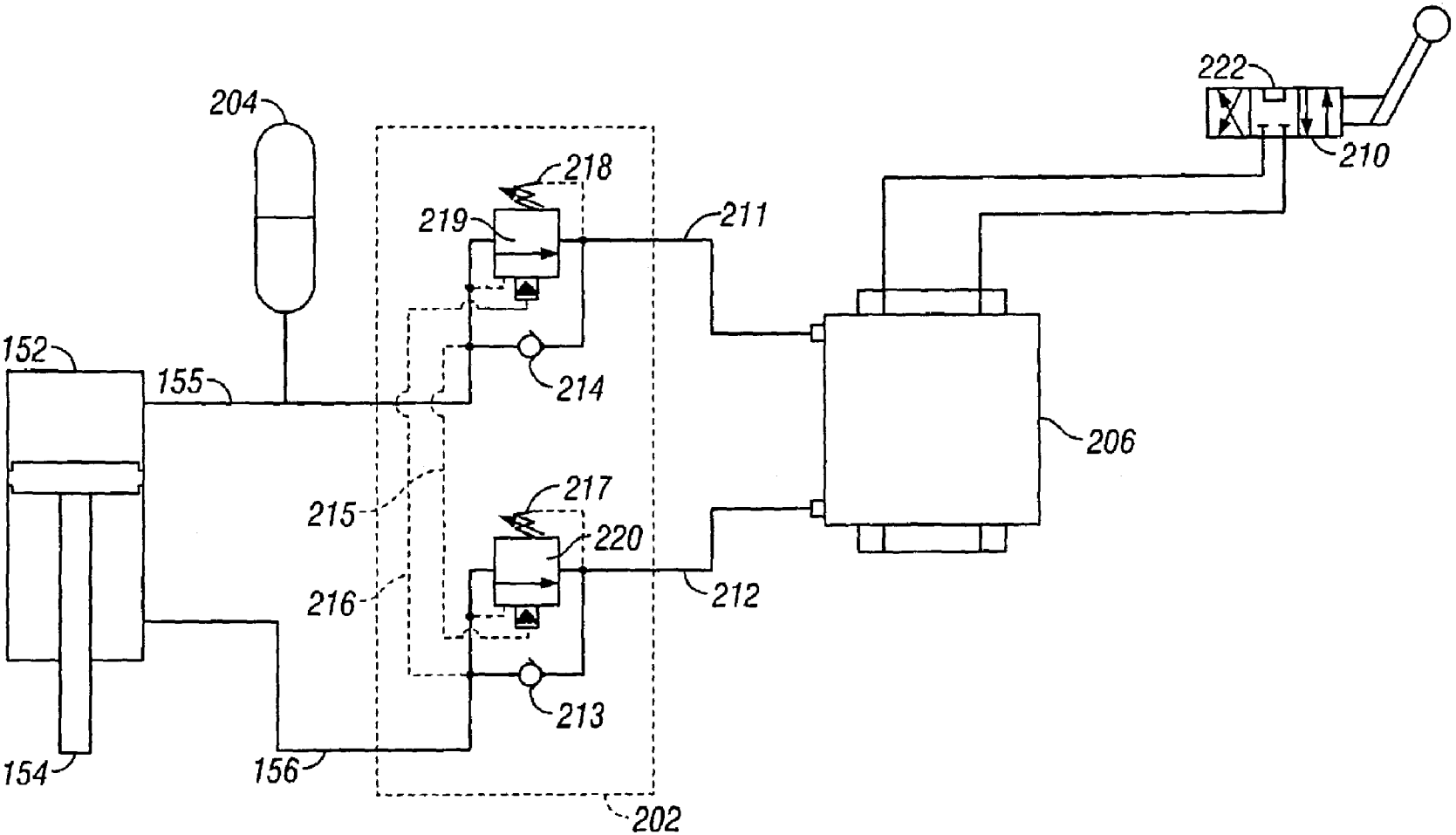
FIG. 11 is a schematic view of a hydraulic circuit useful 10 with a torque head and system according to the present invention.

FIG. 11 shows a fluid control circuit 200 according to the present invention for each piston/cylinder apparatus 151-153. A pair of pilot operated check valves 218, 220 sense a pilot pressure via lines 215 and 216. If the pressure goes below a preset amount, the valves close off lines 155, 156 thereby holding the hydraulic fluid under pressure therein and preventing the pistons 154 from moving. Thus the jaws 141-143 are held in engagement against a casing with a portion in the torque head 100. An accumulator 204 maintains fluid under pressure to provide makeup hydraulic fluid and maintain pressure on the cylinders (e.g. if fluid is lost due to seal damage leakage). Flow to and from the rotary at this swivel union 206, valve 202, accumulator 204, and piston/cylinder apparatuses 151-153 is controlled by a typical multi-position valve (e.g. but not limited to, a three position, two way, open center valve) and control apparatus 210 which can be manually or automatically activated.

Figure 10:
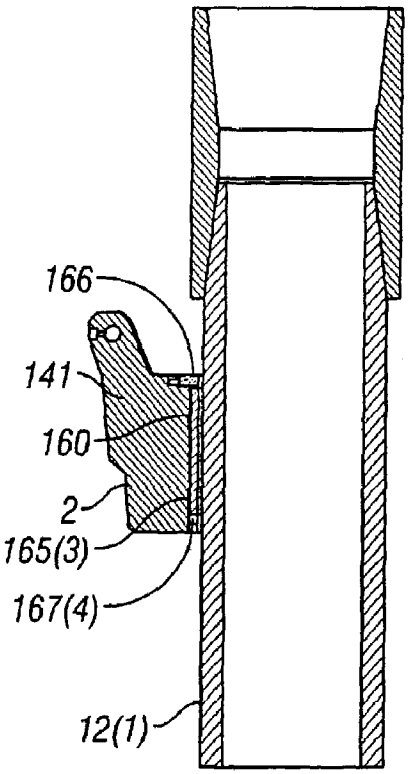
FIGS. 8, 9 and 10 are side views in cross-section showing operation of a slip according to the present invention.
Figure 9:
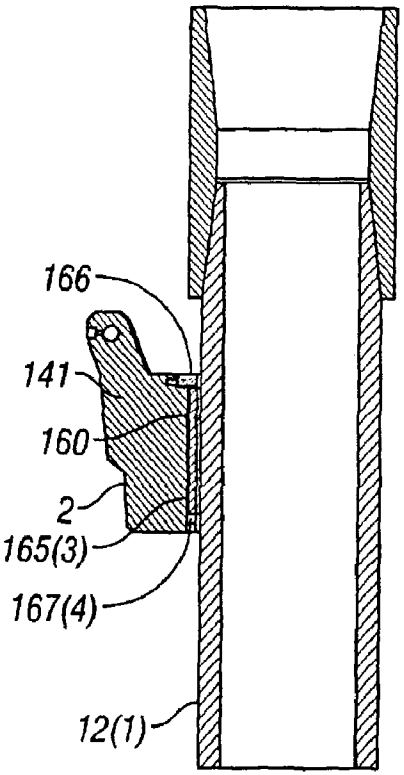
Figure 8A:
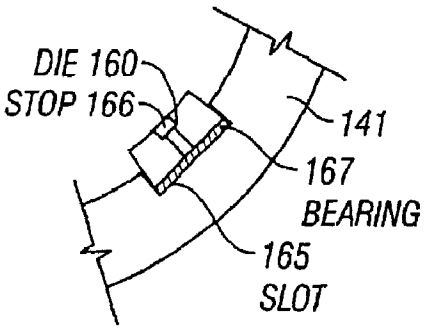
FIG. 8A is a cross-section view of part of FIG. 8.
Figure 8:
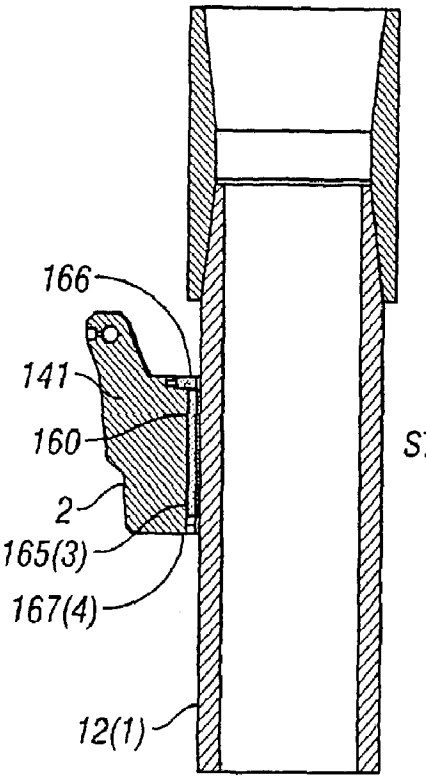

FIGS. 8-10 illustrate movement of the slips 160 with respect to the jaws 141-143 (and thus the possible relative movement of a tubular such as casing relative to the torque head). The controlled movement of these slips 160 permits controlled axial movement between the jaws and casing engaged thereby. The slips are engaged and disengaged by means of the hydraulic actuating cylinders. However, some relative vertical movement of the dies with respect to the slips may occur with vertical movement of the top drive, but this is limited by stops 166 at the top and bottom of the die grooves in the slips. Optionally, a member or bearing insert 167 made of material with a low coefficient of friction, (e.g. but not limited to, thermoplastic material, or carbon fiber, reinforced resin compound material) is positioned between the inner jaw surface and the outer slip or die surface. In one particular aspect these inserts are about one-eighth inch thick. Each slip 160 can move in a groove 165 in the jaws. Removable bolts or screws 166 prevent the slips 160 from escaping from the grooves 165. As shown in FIG. 8, the slip 160 is near yet not engaging an exterior surface of the casing 12. The slip 160 is at the bottom of its groove 165. As shown in FIG. 9, the slip 160 has made initial contact between the slip 160 and casing 12 (the jaw 141 has moved down and radially inwardly). The slip 160 is still at the bottom of the groove 165 and the member 167 provides a bias so that the slip 160 remains fixed in position relative to the casing 12 and jaw 141 and the jaw 141 continues to move down. In certain preferred embodiments, the teeth of the die insure that the frictional forces between the die and casing is significantly higher than the frictional force between the die and slip (due to the material of lower friction coefficient) so that the die is biased to move upward relative to the slip and not the casing as the slip is engaged and is biased to move downward relative to the slip as the slip is moved upward or retracted.

As shown in FIG. 10 the jaw 141 and slip 160 have engaged the 10 casing 12, the jaw 141 has moved further downwardly, and the slip 160 has moved to the top of the groove 165. Such a position of 14, the slip 160, and jaw 141 (and a similar position of the other slips and jaws) prevents lockup or allows recovery from it.

FIGS. 12-16 show steps in a method according to the present invention using a system according to the present invention as described herein, e.g. but not limited to a system as shown in FIGS. 1-11. It is to be understood that in these figures the top drive system is mounted to a typical rig or derrick (not shown).

Figure 12:
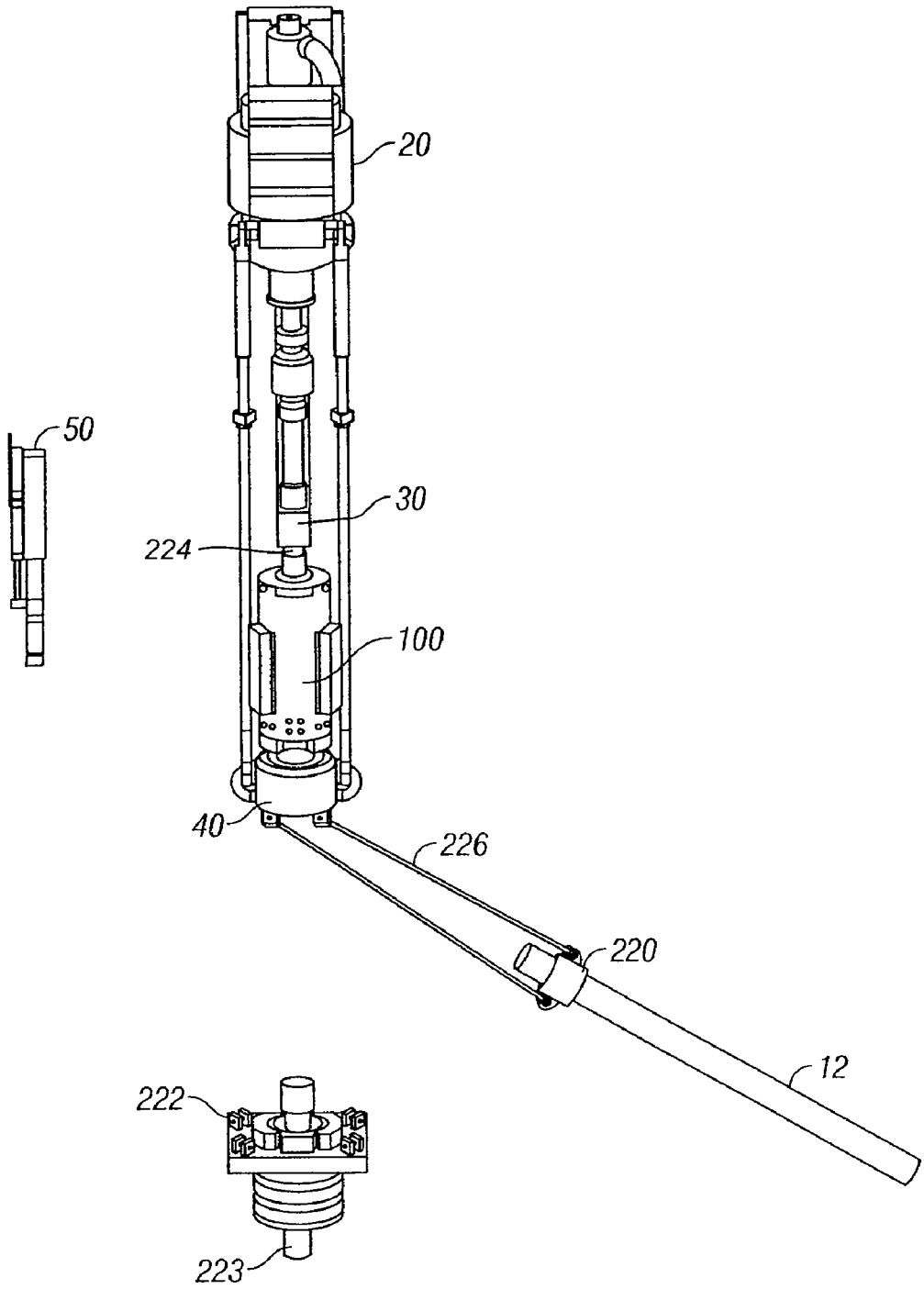
FIGS. 12-16 are side views of steps in a method using a system according to the present invention.

As shown in FIG. 12, a single joint elevator 220 has been secured around a casing joint 12 which is to be added to a casing string 223 that extends down into a wellbore W in the earth. A spider 222 (e.g. but not limited to a flush mounted spider) engages and holds a top part of a top casing joint of the string 223. It is within the scope of this invention to employ any suitable spider and single joint elevator. (Instead of the spider 222 any suitable known clamping or gripping apparatus or device may be used according to the present invention.) Also, optionally, a joint compensator 224 may be used positioned as desired, e.g. but not limited to between the torque head and the top drive. The pipe handler 50 has been lowered.

Figure 13:
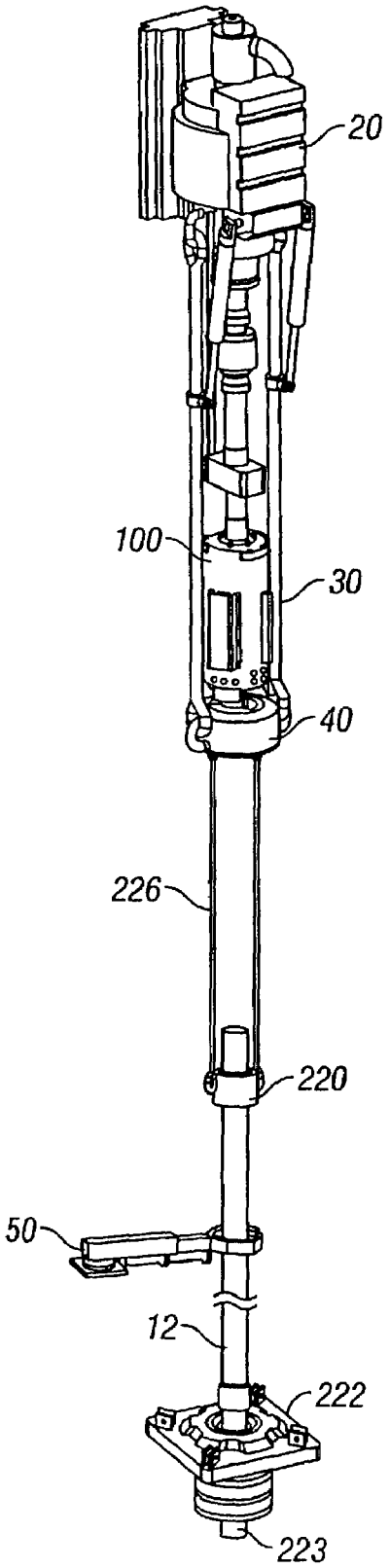
Figure 14:
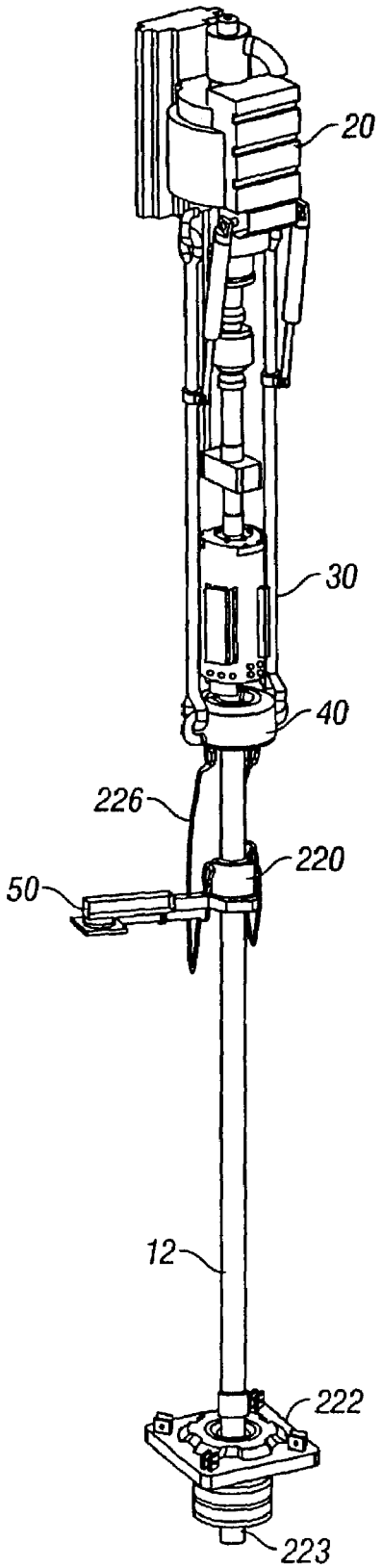

As shown in FIG. 13, the top drive 20 has been raised by the drawworks D (shown schematically) in a derrick of a rig (not shown) and the lower end of the casing 12 has been positioned above the string 223. In FIG. 14, the torque head 100 has been lowered (by lowering the top drive 20 with the drawworks D) by lowering the top drive 20 so that the elevator 40 encompasses the casing 12 and the jaws of the torque head encompass a top portion of the casing 12. The pipe handler 50 has been raised to engage the casing 12 below the elevator 220 to facilitate correct positioning of the casing 12 with respect to the top of the string 223.

Figure 15:
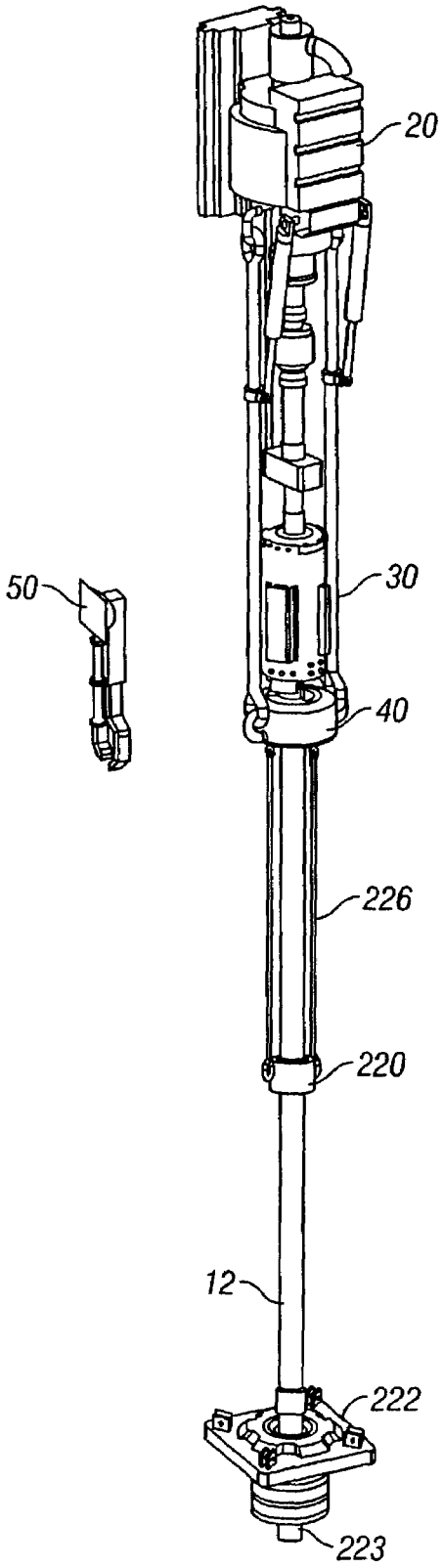
Figure 16:
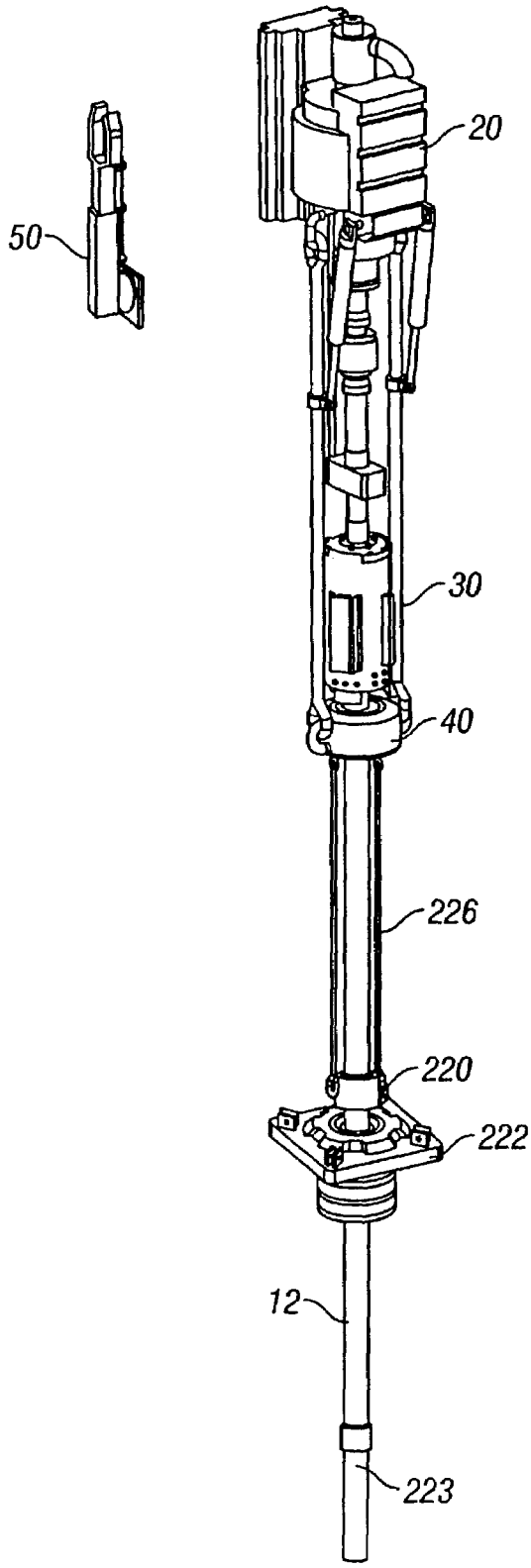
Figure 17:
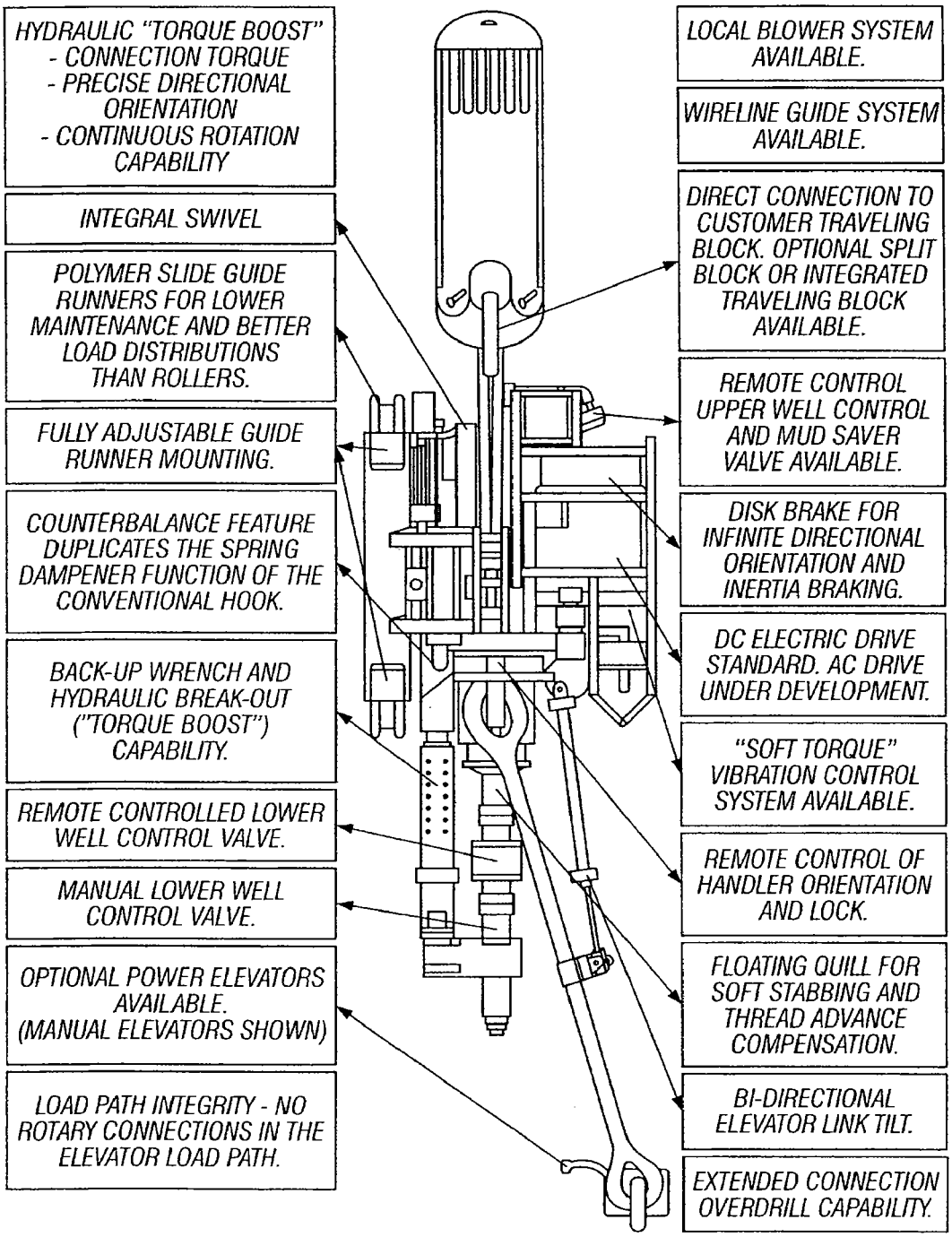
(PRIOR ART) FIG. 17
FIG. 17 is a side view of a prior art top drive system.

As shown in FIG. 15 the jaws of the torque head 100 have engaged the casing 12 to rotate it and the pipe handler 50 has been retracted and lowered out of the way. The top drive 20 has begun to slowly rotate the torque head 100 and, thus, the casing 12 to find the threads in the top joint of the string 223 and then, increasing the rate of rotation, to makeup the new connection. Then (see FIG. 16) the torque head jaws are released, the elevator 40 is activated to engage the casing and slips in the elevator move down to engage the casing; the spider 222 is released, and the top drive 20 is lowered with the drawworks D to lower the entire string 223. Then the spider 222 is reset to engage the casing 12 and the procedure begun in FIG. 12 is repeated to add another joint to the string.

Figure 18:
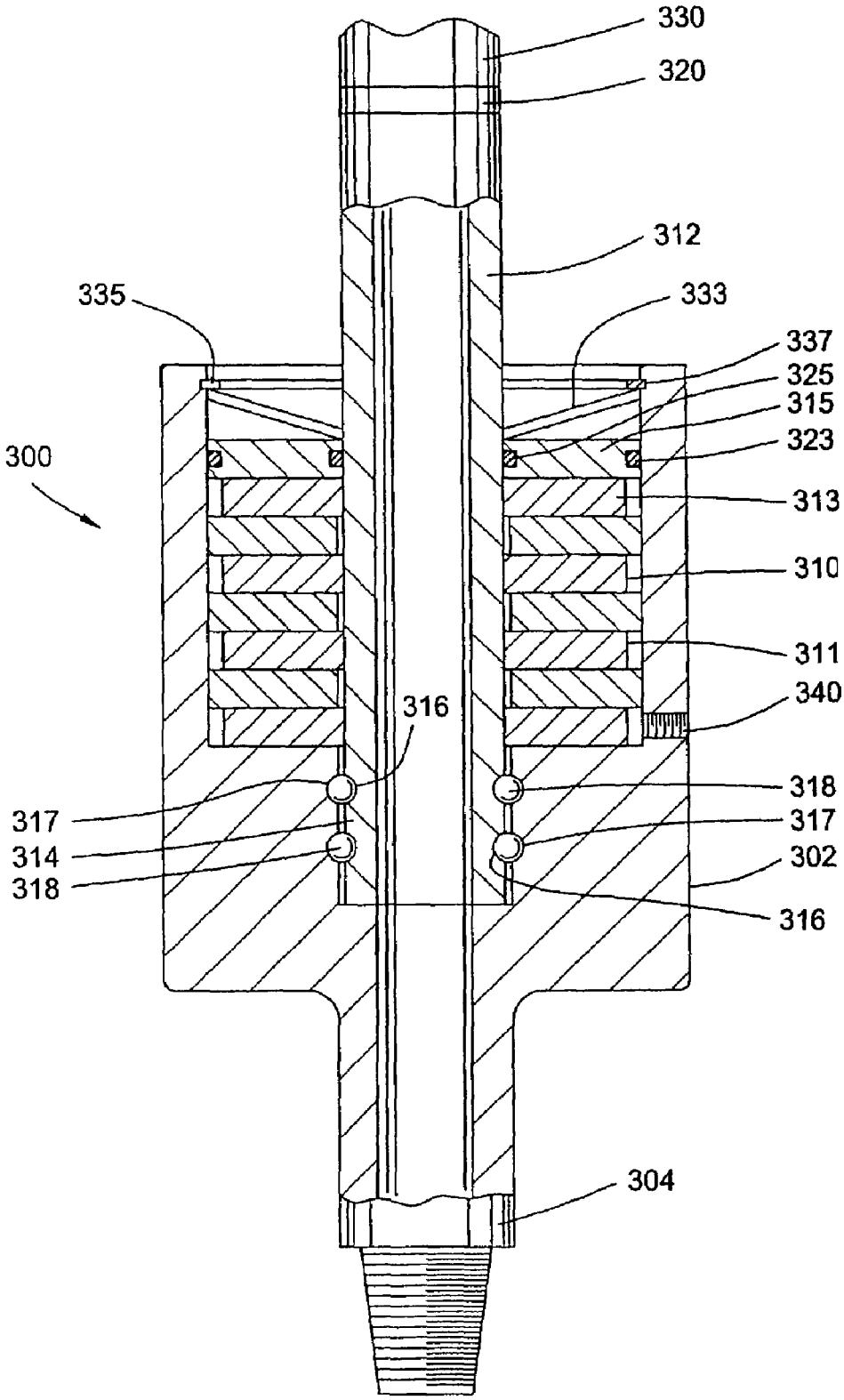
FIG. 18 is a side view in cross-section of a top drive casing 15 system coupler.

FIG. 18 shows a top drive coupler 300 according to the present invention with a body 302 that houses a clutch apparatus 310. The body 302 has a lower threaded end 304. An input shaft 312 has a lower end 314 with bearing recesses 316 for bearings 318 a portion of which also resides in the recesses 317 of the body 302.

The clutch apparatuses 310 has a plurality of spaced-apart clutch plates 311 connected to the housing 302 (e.g. with a splinted connection) and a plurality of spaced-apart clutch plates 313 connected to the input shaft 312. In certain aspects one set or the other of the clutch plates is covered with friction material, e.g. but not limited to typical brake and clutch lining materials. A piston 315 with edge 0-ring seals 323, 325 is healingly disposed above the top most clutch plate 313 in the interior space defined by an outer surface of the shaft 312 and an inner surface of the body 302. A spring apparatus 333 urges the piston 315 down, energizing the clutch. A snap ring 335 with a portion in a recess 337 of the body 302 holds the spring apparatus 333 in place. In one aspect the apparatus 333 is one or more belleville springs. FIG. 18 shows schematically a coupling 320 connected to or formed integrally of the shaft 312 and a top drive 330 connected releasable to the coupling 320. The coupler 300 provides for the selective rotation of an item connected beneath it by the selective engagement of the clutch apparatus and may be used, e.g., with any top drive casing make-up system, including those according to the present invention. A coupler 300 may be used to selectively increase, reduce, or stop the transmission of torque from the top drive to the torque head and/or other top drive driven devices, e.g. but not limited, tubular torque transmission devices; milling apparatuses and systems; drilling apparatuses and systems; and/or external or internal tubular gripping devices. A coupler 300 may be used with a power swivel. Through a channel 340 is selectively provided fluid under pressure (e.g. from a typical rig system or from a rig joint make-up monitor system) to reenergize the apparatus 300, e.g., just prior to an indication of the shouldering of a joint. Alternatively, to effect reenergizing, the spring apparatus 333 is deleted and the channel 340 is placed so that fluid is applied on top of the piston (with some seal member above the plates).

The present invention, therefore, provides in certain, but not necessarily all embodiments, a torque head for gripping a tubular member (e.g. but not limited to casing that is part of a casing string), the torque head with a housing, and grip mechanism within the housing for selectively gripping a tubular member within the housing; such a torque head wherein the grip mechanism is able to grip the tubular member and exert both axial and tensional forces on the tubular member while it is gripped; and/or such a torque head with a top drive connected to the torque head.

Provided, therefore, in certain aspects, a torque head with a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable. Such a torque head may have one, some, any combination of, or all the following: wherein the die apparatus is movably upwardly as the portion of the tubular is engaged and downwardly as the portion of the tubular is disengaged; a bearing insert disposed between the die apparatus and the at least one jaw for facilitating movement of the die apparatus with respect to the at least one jaw; wherein the bearing insert is made from thermoplastic material or carbon-fiber reinforced resin compound; the die apparatus positioned in a recess in the at least one jaw, and a stop member secured to the at least one jaw with a portion thereof projecting into the recess of the at least one jaw for limiting movement of the die apparatus and for preventing escape of the die apparatus from the recess; releasable connection apparatus for releasable connecting the torque head to another item; the releasable connection apparatus including a top plate mounted to a top of the housing, a top barrel mounted to the top plate, and the top barrel mounted to the top plate with shear bolts sharable in response to a predetermined load for selective separation of the top barrel from the top plate; wherein there is spring apparatus between the top barrel and the top plate providing for limited axial movement of the top barrel with respect to the top plate; a piston-cylinder apparatus interconnected between the at least one jaw and the housing for selectively moving the at least one jaw into and out of engagement with the portion of the tubular member; guide apparatus connected to the at least one jaw for guiding movement of the at least one jaw fluid circulation apparatus for selectively continuously providing fluid to a tubular member gripped by the torque head; wherein the tubular member is connected to a tubular string extending downwardly from the torque head and the fluid circulation apparatus circulates fluid to the tubular string during operation of the torque head; at least one lower member secured at the bottom of the housing with an inclined portion for facilitating entry of a tubular member into the housing; wherein the at least one lower member is a plurality of spaced-apart lower members; and/or wherein the at least one jaw is a plurality of spaced-apart jaws.

The present invention, therefore, provides in certain, but not necessarily all embodiments, a torque head for gripping tubular members, the torque head with a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, wherein the die apparatus is movably upwardly as the portion of the tubular is engaged and downwardly as the portion of the tubular is disengaged, a bearing insert disposed between each die apparatus and each jaw for facilitating movement of the die apparatus with respect to the jaw, and releasable connection apparatus for releasable connecting the torque head to another item. Such a torque head may have one, some, any combination of, or all the following: torque head may have a top drive releasable secured to and above it.

The present invention, therefore, provides in certain, but not necessarily all embodiments, a torque head for gripping tubular members, the torque head with a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable, and releasable connection apparatus for releasable connecting the torque head to another item; a top plate mounted to a top of the housing, a top barrel mounted to the top plate, and the top barrel mounted to the top plate with shear bolts sharable in response to a predetermined load for selective separation of the top barrel from the top plate; wherein there is spring apparatus between the top barrel and the top plate providing for limited axial movement of the top barrel with respect to the top plate; fluid circulation apparatus for selectively continuously providing fluid to a tubular member gripped by the torque head; and/or a top drive releasable secured to and above the torque head.

The present invention, therefore, provides in certain, but not necessarily all embodiments, a top drive system with a top drive, bails connected to and extending beneath the top drive, elevator apparatus connected to a lower end of the bails, wrenching apparatus interconnected with the top drive and positioned there beneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable; and such a top drive system including pipe handler apparatus disposed beneath the elevator apparatus.

The present invention, therefore, provides in certain, but not necessarily all embodiments, a top drive system with a top drive, bails connected to and extending beneath the top drive, elevator apparatus connected to a lower end of the bails, wrenching apparatus interconnected with the top drive and positioned there beneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, and releasable connection apparatus for releasable connecting the torque head to another item; and such a top drive system including pipe handler apparatus disposed beneath the elevator apparatus.

The present invention, therefore, provides in certain, but not necessarily all embodiments, a method for connecting a first tubular member to a second tubular member, the method including engaging the first tubular member with a first elevator secured to and beneath a second elevator, the second elevator comprising a component of a top drive system, the top drive system comprising a top drive, bails connected to and extending beneath the top drive, elevator apparatus connected to a lower end of the bails, wrenching apparatus interconnected with the top drive and positioned there beneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted to the at least one jaw, the die apparatus movable with respect to the at least one jaw so that relative movement of the tubular with respect to the torque head is possible to the extent that the die apparatus is movable, lifting the first tubular member above the second tubular member, the second tubular member held in position by a spider, lowering the top drive system so an upper end of the first tubular member enters the torque head and gripping said upper end with the torque head, lowering with the top drive the first tubular member so that a lower threaded end thereof enters an upper threaded end of the second tubular member, and rotating the first tubular member with the top drive to threadedly connect the first tubular member to the second tubular member; such a method including facilitating positioning of the first tubular member with pipe handling apparatus selectively engaging the first tubular member; such a method wherein the top drive is movably mounted in a rig and the spider is a flush mounted spider on a rig floor; such a method wherein the second tubular member is a top tubular of a tubular string extending down into earth; and/or such a method wherein the tubular members are casing.

The present invention, therefore, provides in certain, but not necessarily all embodiments, a method for disconnecting a first tubular member from a second tubular member, the method including engaging a top end of the first tubular member with a torque head of a top drive system, the top drive system comprising a top drive bails connected to and extending beneath the top drive, elevator apparatus connected to a lower end of the bails, wrenching apparatus interconnected with the top drive and positioned there beneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including at least one jaw selectively movable toward and away from a portion of a tubular member within the housing, the at least one jaw having mounted thereon slip apparatus for engaging the portion of the tubular member, the slip apparatus including die apparatus movably mounted thereto, the die apparatus movable with respect to the at least one jaw so that relative movement of the tubular with respect to the torque head is possible to the extent that the die apparatus is movable, rotating the first tubular with the top drive to disconnect the first tubular from the second tubular.

The present invention, therefore, provides in certain, but not necessarily all embodiments, a method for connecting a first tubular member to a second tubular member, the method including engaging the first tubular member with a first elevator secured to and beneath a second elevator, the second elevator comprising a component of a top drive system, the top drive system comprising a top drive, bails connected to and extending beneath the top drive, elevator apparatus connected to a lower end of the bails, wrenching apparatus interconnected with the top drive and positioned there beneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, and releasable connection apparatus for releasable connecting the torque head to another item, lifting the first tubular member above the second tubular member, the second tubular member held in position by a spider, lowering the top drive system so an upper end of the first tubular member enters the torque head and gripping said upper end with the torque head, lowering with the top drive the first tubular member so that a lower threaded end thereof enters an upper threaded end of the second tubular member, and rotating the first tubular member with the top drive to threadedly connect the first tubular member to the second tubular member.

The present invention, therefore, provides in certain, but not necessarily all embodiments, a method for disconnecting a first tubular member from a second tubular member, the method including engaging a top end of the first tubular member with a torque head of a top drive system, the top drive system comprising a top drive, bails connected to and extending beneath the top drive, elevator apparatus connected to a lower end of the bails, wrenching apparatus interconnected with the top drive and positioned there beneath, and a torque head connected to the top drive for selective rotation thereby and therewith, the torque head positioned beneath the wrenching apparatus, the torque head comprising a housing, grip mechanism secured within the housing, the grip mechanism for selectively gripping a tubular member, the grip mechanism including a plurality of spaced-apart jaws selectively movable toward and away from a portion of a tubular member within the housing, each jaw having mounted thereon slip apparatus for engaging the portion of the tubular member, each slip apparatus including die apparatus movably mounted to a corresponding jaw, the die apparatus movable with respect to the jaws so that relative movement of the tubular with respect to the torque head is possible to the extent that the die apparatus is movable, and releasable connection apparatus for releasable connecting the torque head to another item, and rotating the first tubular with the top drive to disconnect the first tubular from the second tubular.

The present invention, therefore, provides in certain, but not necessarily all embodiments, a coupler device for coupling a torquing device to an item to be rotated thereby, the coupler device with a body with a first end and a second end, a recess in the first end of the body, a shaft with a shaft first end and a shaft second end, at least part of the shaft within the recess of the body, a clutch apparatus in the recess of the body, and clutch energizing apparatus for energizing the clutch apparatus; clutch reenergizing apparatus for reenergizing the clutch apparatus; and/or such a coupler device with the clutch apparatus having a plurality of spaced-apart shaft clutch plates connected to the shaft and projecting out there from into the recess of the body, a plurality of spaced-apart body clutch plates connected to and projecting inwardly into the recess of the body, and the plurality of spaced-apart shaft clutch plates interleaved with the plurality of spaced-apart body clutch plates.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention as set forth in the following claims.

The invention claimed is:

1. A method for making a threaded connection between a first threaded downhole tubular and a second threaded downhole tubular, comprising:

providing a rig structure having a top drive operatively connected thereto;

providing a gripping member, operatively connected to the top drive, for gripping the first threaded downhole tubular;

gripping the first threaded downhole tubular with the gripping member;

aligning a first thread on the first threaded downhole tubular with respect to a second thread on the second threaded downhole tubular;

operating the top drive, thereby rotating the gripping member and the first threaded downhole tubular and thereby inter-engaging the first and second threads;

measuring a torque developed at the inter-engaging first and second threads during make-up;

controlling the top drive to adjust the torque in response to the measured torque and prior to an indication of shouldering between the first and second threaded downhole tubulars; and continue making the threaded connection after adjustment of the torque.

2. The method of claim 1, further comprising gripping the second threaded downhole tubular with a second gripping member.

3. The method of claim 1, wherein measuring the torque comprises measuring a plurality of torques.

4. The method of claim 1, wherein controlling the top drive to adjust the torque comprises increasing the torque.

5. The method of claim 1, wherein controlling the top drive to adjust the torque comprises selectively rotating the top drive.

6. The method of claim 1, further comprising:

operating the top drive thereby rotating the first threaded downhole tubular and the second threaded downhole tubular to drill within the wellbore;

measuring the torque developed in response to rotation of the first and second threaded downhole tubulars; and controlling an output of the top drive in response to the measured torque.

7. The method of claim 1, wherein each of the first and second threaded downhole tubulars comprises a casing.

8. The method of claim 1, further comprising lowering the connected first and second threaded downhole tubular.

9. The method of claim 8, further comprising circulating a drilling fluid through the gripping member.

10. The method of claim 8, wherein controlling the top drive to adjust the torque, comprises:

connecting a coupler to the top drive and the gripping member; and operating the coupler to control the amount of torque transfer from the top drive to the gripping member.

11. The method of claim 1, further comprising deenergizing the torque just prior to the indication of a shouldering of the first and second threaded downhole tubulars.

12. The method of claim 11, further comprising providing a thread compensator and compensating for a threaded connection.

13. The method of claim 1, further comprising providing a thread compensator and compensating for a threaded connection.

14. A method for rotating a tubular member comprising:

providing a rig structure having a top drive operatively connected thereto;

providing a gripping member, operatively connected to the top drive, for gripping the tubular member;

gripping the tubular member with the gripping member;

operating the top drive to rotate the gripping member and thereby rotating the tubular member;

measuring a torque developed in response to rotation of the tubular member;

adjusting the torque during the rotation of the tubular member in response to the measured torque and prior to an indication of shouldering of the tubular member; and rotating the tubular member after adjustment of the torque.

15. The method of claim 14, wherein the gripping member further comprises a torque sub.

16. The method of claim 14, further comprising connecting a drilling apparatus to the tubular member and rotating the tubular member.

17. The method of claim 14, further comprising connecting the tubular member to a second tubular member.

18. The method of claim 17, further comprising providing a thread compensator and compensating for a threaded connection.

19. An apparatus for making a threaded connection between a first downhole tubular and a second downhole tubular comprising:

a rig structure having a top drive operatively connected thereto;

a first gripping member operatively connected to the top drive for gripping the first downhole tubular;

a second gripping member for restraining the second downhole tubular;

a torque measuring device for measuring a torque between the first and second downhole tubulars during makeup of the threaded connection;

a controller for controlling an output of the top drive in response to the measured torque;

a joint compensator disposed between the top drive and the first gripping member; and a fluid fill-up circulating tool connected to the first gripping member, wherein the top drive, the torque measuring device, the joint compensator, and the fluid fill-up circulating tool are in fluid communication for circulating a fluid from the top drive to the first downhole tubular gripped by the first gripping member.

20. The apparatus of claim 19, wherein the torque measuring device comprises a torque sub.

21. The apparatus of claim 19, wherein the torque measuring device is operatively located between the top drive and the gripping member.

22. The apparatus of claim 19, wherein the torque measuring device further comprises a joint make-up monitoring system.

23. The apparatus of claim 19, further comprising a joint make-up monitoring system.

24. The apparatus of claim 19, wherein the first gripping member comprises slips.

25. The apparatus of claim 24, wherein the first gripping member comprises non-marking slips.

26. The apparatus of claim 22, wherein the torque measuring device further comprises a torque sub.

27. The apparatus of claim 19, further comprising a swivel.

28. The apparatus of claim 19, wherein the first gripping member comprises radially movable gripping elements.

29. The apparatus of claim 28, wherein the gripping elements are hydraulically actuated.

30. The apparatus of claim 29, wherein the gripping elements comprise slips.

31. An apparatus for making up tubulars, comprising:

a rotational device disposable above a well floor;

a tubular gripping member operatively connected to the rotational device, the gripping member having one or more radially extendable elements for gripping a first downhole tubular;

a measuring device for measuring torque developed within a threaded connection as the first downhole tubular is rotated into threaded engagement with a second downhole tubular;

a thread compensator coupled to the tubular gripping member; and a controller for controlling the rotational device in response to a torque measured by the measuring device, wherein the rotational device and the thread compensator are in fluid communication with the first downhole tubular for circulating a fluid to the first downhole tubular gripped by the tubular gripping member.

32. The apparatus of claim 31, wherein the rotational device is de-energized when the measured torque reaches a predetermined torque.

33. The apparatus of claim 31, further comprising a swivel.

34. The apparatus of claim 31, further comprising a coupler for selectively transmitting torque from the rotational device.

35. A method for making a threaded connection between a first threaded wellbore casing and a threaded wellbore casing string, comprising:

providing a rig structure having a top drive operatively connected thereto;

providing a gripping member having radially movable gripping elements and being operatively connected to the top drive, for gripping the first threaded wellbore casing;

operatively connecting a coupler between the top drive and the gripping member;

gripping the first threaded wellbore casing with the gripping elements;

aligning a first thread on the first threaded wellbore casing with respect to a second thread on the threaded wellbore casing string;

operating the top drive, thereby rotating the gripping member and the first threaded wellbore casing and thereby inter-engaging the first and second threads;

measuring a torque developed at the inter-engaging first and second threads during make-up;

controlling the top drive to adjust the torque in response to the measured torque; and operating the coupler to control the amount of torque transfer from the top drive to the gripping member.

36. The method of claim 35, further comprising inserting a circulating tool into the first threaded wellbore casing.

37. The method of claim 35, wherein the gripping elements comprise jaws.

38. The method of claim 35, wherein the gripping elements comprise slips.

39. The method of claim 35, wherein operating the coupler comprises deenergizing the torque just prior to an indication of a shouldering of the first and second threads.

40. The method of claim 39, further comprising providing a thread compensator and compensating for a threaded connection.

41. A method for making a threaded connection between a first threaded downhole tubular and a second threaded downhole tubular, comprising:

providing a rig structure having a top drive operatively connected thereto;

providing a gripping member, operatively connected to the top drive, for gripping the first threaded downhole tubular;

gripping the first threaded downhole tubular with the gripping member;

aligning a first thread on the first threaded downhole tubular with respect to a second thread on the second threaded downhole tubular;

operating the top drive, thereby rotating the gripping member and the first threaded downhole tubular and thereby inter-engaging the first and second threads;

measuring a torque developed at the inter-engaging first and second threads during make-up;

controlling the top drive to adjust the torque in response to the measured torque;

de-energizing the torque just prior to an indication of a shouldering of the first and second threads; and continue making the threaded connection at the adjusted torque.

42. A method for making a threaded connection between a first threaded downhole tubular and a second threaded downhole tubular, comprising:

providing a rig structure having a top drive operatively connected thereto;

providing a gripping member, operatively connected to the top drive, for gripping the first threaded downhole tubular;

gripping the first threaded downhole tubular with the gripping member;

aligning a first thread on the first threaded downhole tubular with respect to a second thread on the second threaded downhole tubular;

operating the top drive, thereby rotating the gripping member and the first threaded downhole tubular and thereby inter-engaging the first and second threads;

measuring a torque developed at the inter-engaging first and second threads during make-up;

controlling the top drive to adjust the torque in response to the measured torque, wherein controlling the top drive to adjust the torque comprises connecting a coupler to the top drive and the gripping member and operating the coupler to control the amount of torque transfer from the top drive to the gripping member;

continue making the threaded connection at the adjusted torque; and lowering the connected first and second threaded downhole tubular.

43. A method for making a threaded connection between tubular members, comprising:

providing a rig structure having a top drive operatively connected thereto;

providing a gripping member that is operatively connected to the top drive;

providing a coupler that is operatively connected to the top drive and the gripping member;

gripping a first tubular with the gripping member;

aligning the first tubular with respect to a second tubular;

rotating the first tubular using the top drive and the gripping member to make up a threaded connection between the first and second tubular;

measuring a torque developed at the threaded connection during make up;

operating the coupler to adjust the torque transfer from the top drive to the gripping member in response to the measured torque; and continuing to make up the threaded connection after adjustment of the torque.

44. The method of claim 43, further comprising de-energizing the coupler prior to an indication of shouldering of the first and second tubulars.

* * * * *

UNITED STATES PATENT AND TRADEMARK OFFICE

CERTIFICATE OF CORRECTION

PATENT NO. : 7,712,523 B2
APPLICATION NO. : 10/389483
DATED : May 11, 2010
INVENTOR(S) : Snider et al.

It is certified that error appears in the above-identified patent and that said Letters Patent is hereby corrected as shown below:

Title page, in the References Cited (56):

Please delete "2,666,689 A 2/1954 Cormany" and insert --2,668,689 A 2/1954 Cormany-- therefor;

Column 14, Claim 11, Line 2, please delete "a";

Column 17, Claim 43, Line 3, please delete "tubular" and insert --tubulars-- therefor.

Signed and Sealed this

Thirty-first Day of August, 2010

David J. Kappos

David J. Kappos
*Director of the United States Patent and Trademark Office*